US006983952B2

(12) United States Patent
Golling

(10) Patent No.: US 6,983,952 B2
(45) Date of Patent: Jan. 10, 2006

(54) APPARATUS FOR GLIDING OVER SNOW

(76) Inventor: Eugene Golling, 1823 S. Hope St., Los Angeles, CA (US) 90015

( * ) Notice: Subject to any disclaimer, the term of this patent is extended or adjusted under 35 U.S.C. 154(b) by 208 days.

(21) Appl. No.: 10/219,873

(22) Filed: Aug. 14, 2002

(65) Prior Publication Data

US 2003/0047910 A1 Mar. 13, 2003

Related U.S. Application Data

(63) Continuation-in-part of application No. 09/969,805, filed on Oct. 2, 2001, now Pat. No. 6,616,151.

(51) Int. Cl.
*A63C 9/02* (2006.01)

(52) U.S. Cl. ..... 280/612; 280/14.21; 280/14.24

(58) Field of Classification Search ..... 280/611, 280/612, 617, 618, 623, 626, 629, 633, 11.3, 280/14.21, 14.22, 14.24
See application file for complete search history.

(56) References Cited

U.S. PATENT DOCUMENTS 3,781,028 A * 12/1973 Gertsch et al. ..... 280/618
3,838,866 A * 10/1974 D'Alessio et al. ..... 280/618
3,927,897 A * 12/1975 Olson et al. ..... 280/612
3,963,253 A * 6/1976 Rieger ..... 280/616
4,251,090 A * 2/1981 Weigl ..... 280/618
4,261,595 A * 4/1981 Smialowski et al. ..... 280/614
4,319,767 A * 3/1982 Emilson ..... 280/614
4,410,199 A * 10/1983 Eisenberg ..... 280/615
4,505,493 A * 3/1985 Gustavsson ..... 280/617
4,512,594 A * 4/1985 Eyre ..... 280/614
4,703,946 A * 11/1987 Nava ..... 280/627
5,704,139 A * 1/1998 Okajima ..... 36/115
6,616,151 B1 * 9/2003 Golling ..... 280/14.21

* cited by examiner

*Primary Examiner*—Bryan Fischmann
*Assistant Examiner*—Bridget Avery
(74) *Attorney, Agent, or Firm*—James E. Brunton, Esq.

(57) ABSTRACT

A universal snow boot and binding for use in connection with either snow skiing or snow boarding which is easy to use and provides quick, easy and positive interconnection of the snow boot with the upper surface of the ski or snowboard. A unique feature of the invention is to use magnetic forces in cooperation with a novel mechanical locking mechanism to removably affix the snow boot to the ski or snowboard.

2 Claims, 27 Drawing Sheets

70
76b
82
80
78
-70a-
76
30
20
72
22
-76a-
32
66
14
87
66
84b
-14a-
91
84
36
62
63
60
36
37
89
84a
42
40
52
54
46
50a
-14a-
14
50

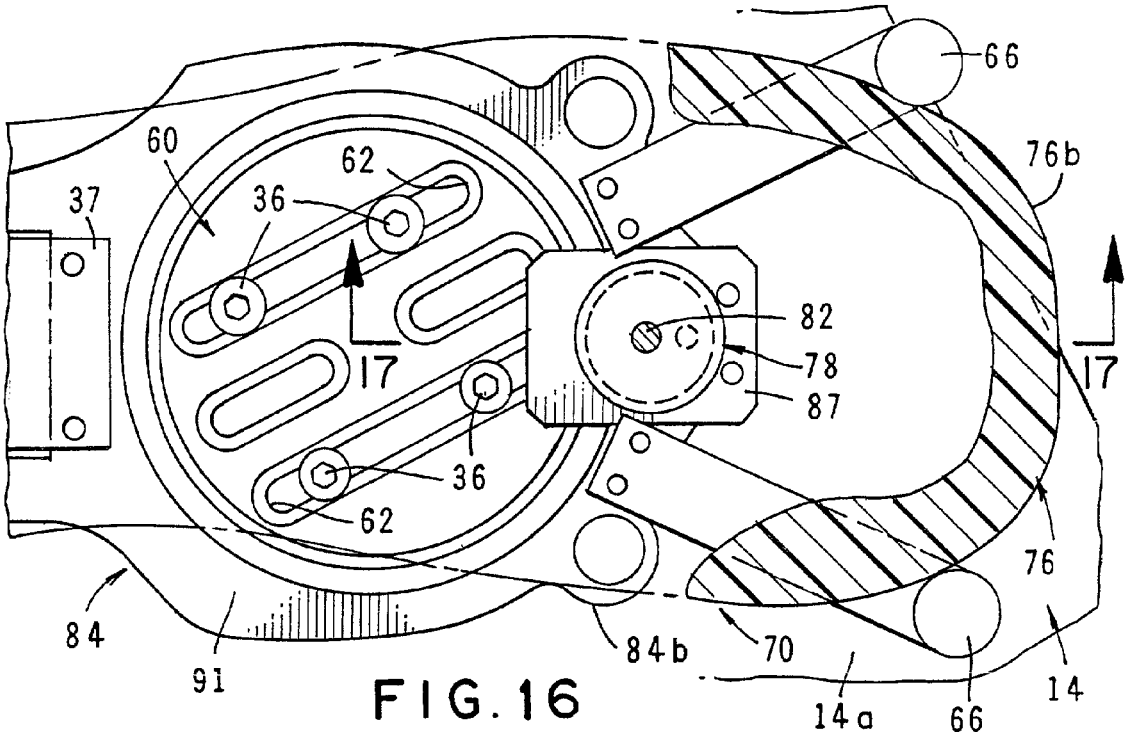
FIG. 16
FIG. 17
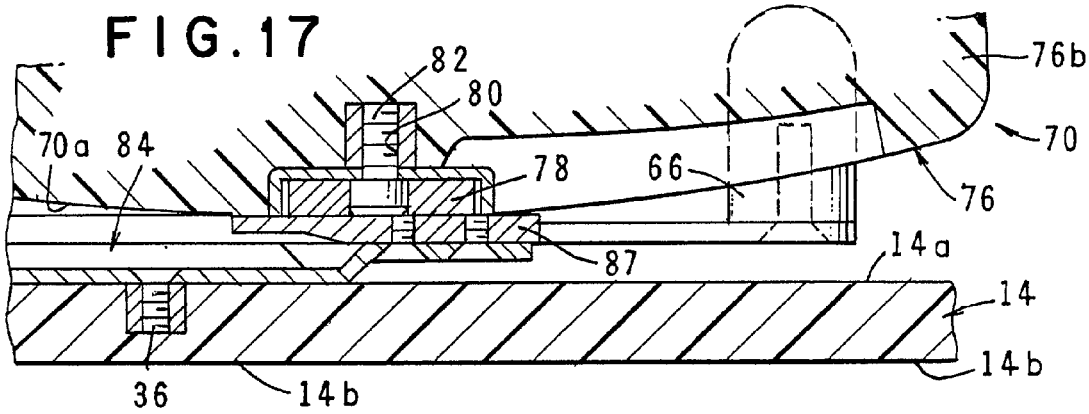
FIG. 18
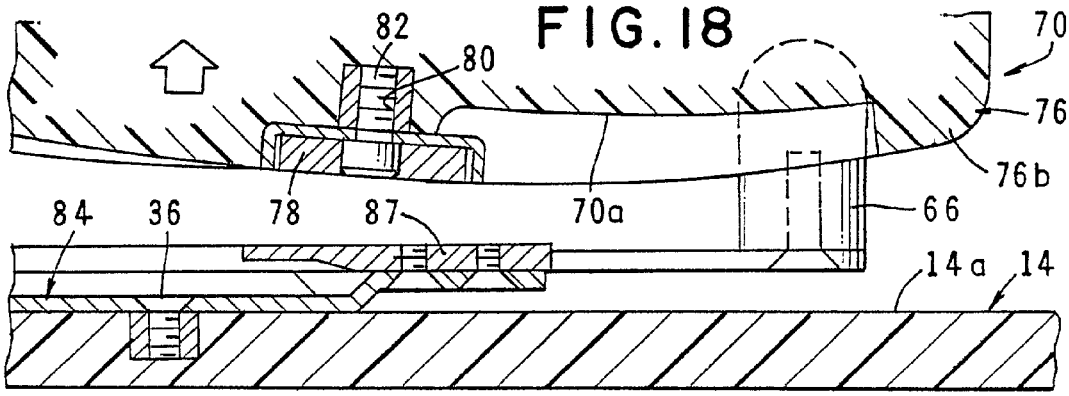

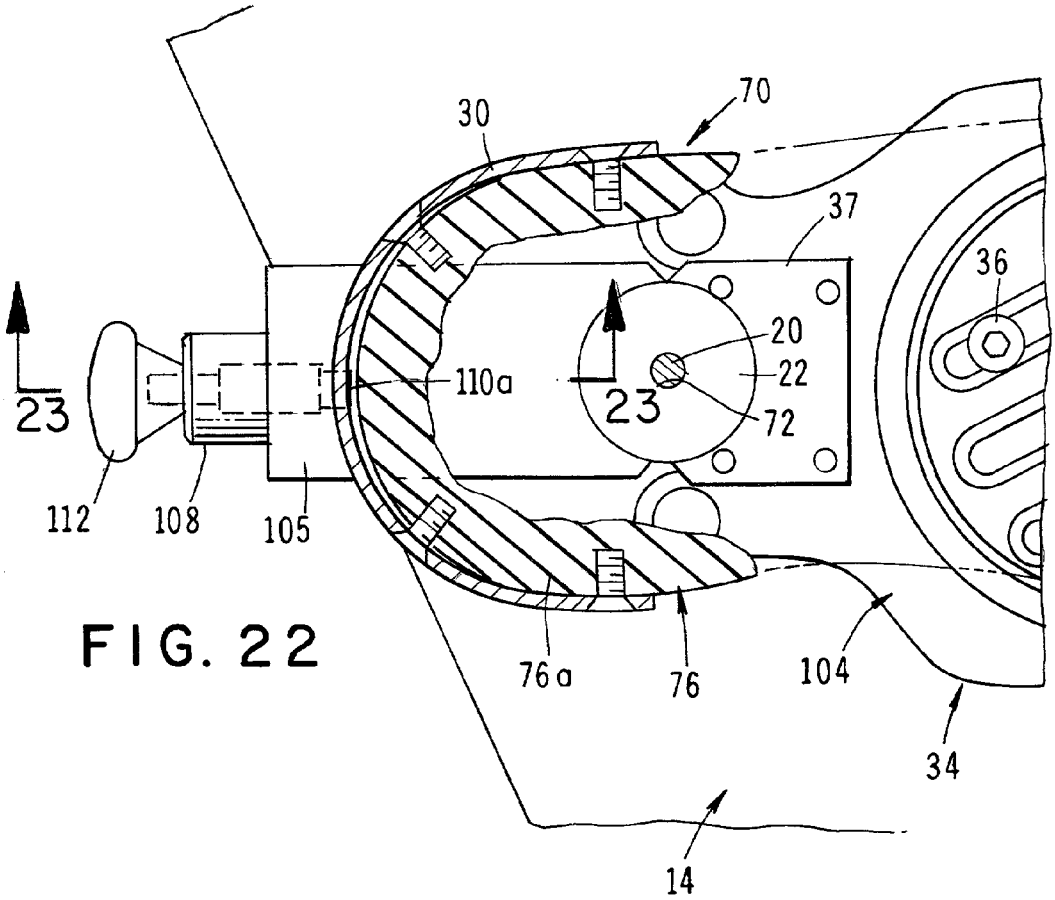
FIG. 22
FIG. 23
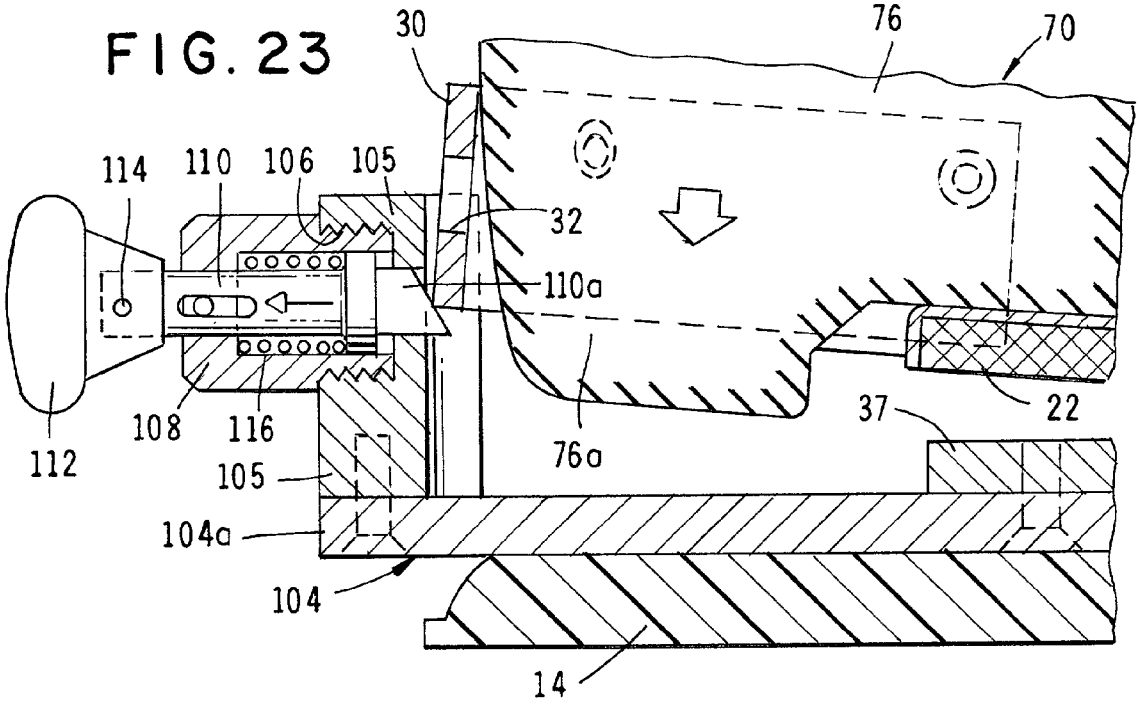

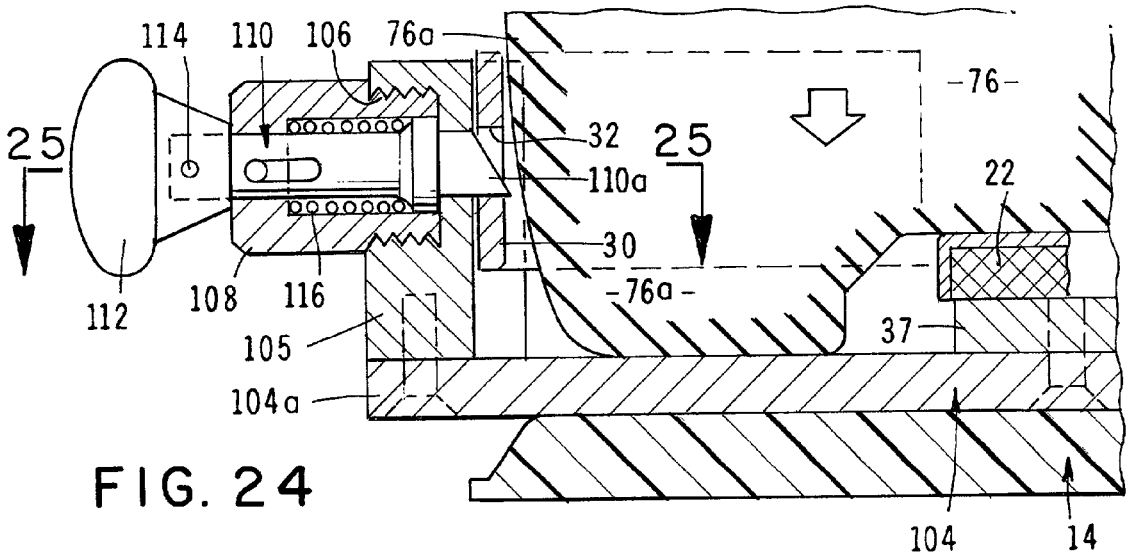
FIG. 24
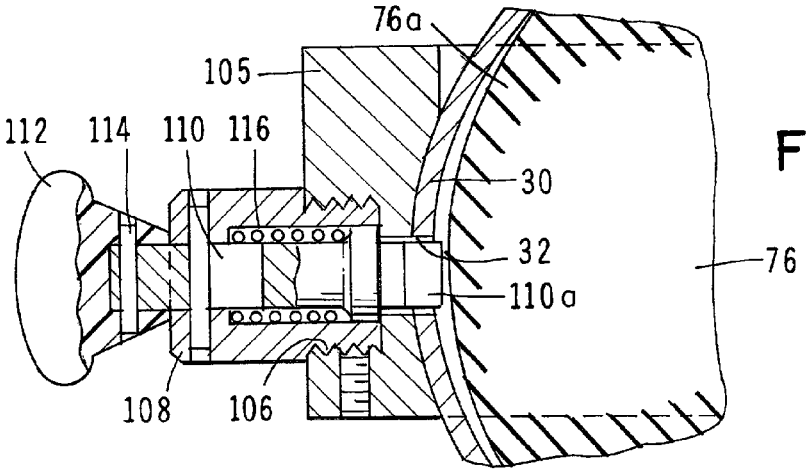
FIG. 25
FIG. 26
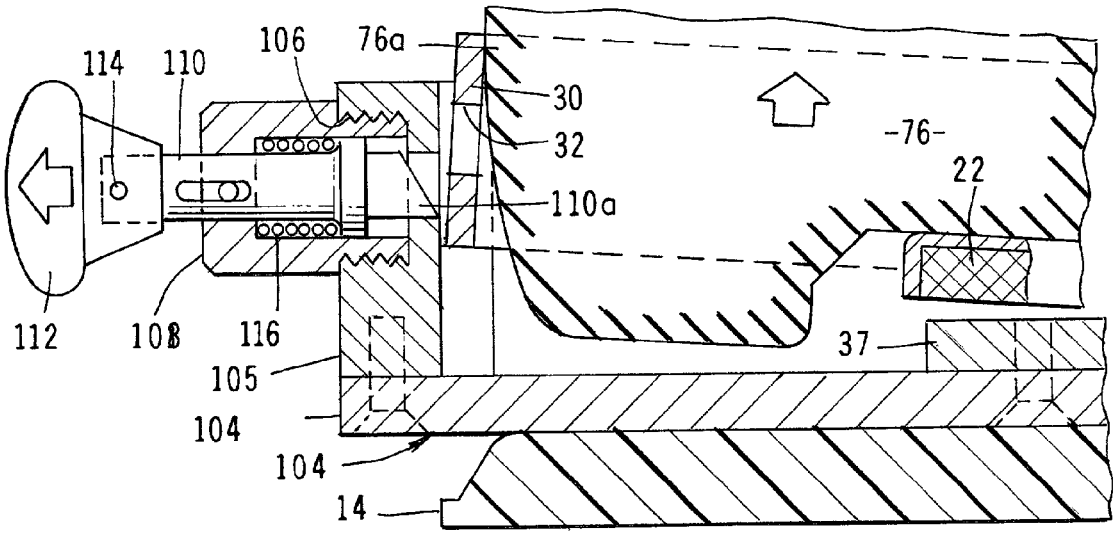

160
162
162a
162b
166
166a
166b
166c
168
169
176
179
172
189
130
130a
14
40
40

APPARATUS FOR GLIDING OVER SNOW

This is a Continuation-In-Part Application of application Ser. No. 09/969,805 filed Oct. 2, 2001 now U.S. Pat. No. 6,616,151.

BACKGROUND OF THE INVENTION

1. Field of the Invention

The present invention relates generally to a winter sport apparatus. More particularly, the invention concerns an apparatus for gliding over snow which includes unique snow boots that are removably connected to a snow engaging support base such as a snow-board through the use of a magnet and a cooperating mechanical locking mechanism.

2. Discussion of the Prior Art

Winter sports such as skiing, ice-skating and a snowshoeing have traditionally been very popular in many locations within the United States and in foreign countries. While, for many years snow skiing was the sport of choice among winter sport enthusiasts, recently, the sport of snowboarding has catapulted into popularity particularly among young persons.

With the increase in popularity of snow boarding has come the demand for better and easier-to-use equipment. Particularly in demand is the need for superior boots and bindings. As a general rule, the boots and bindings used for snow boarding are the same as used for snow skiing and closely resemble those which have been used for over fifty years. Typically, the bindings comprise rather heavy, bulky frames which are affixed to the upper surface of the snow-board with the boots being affixed to the frames by conventional types of straps, buckles and wires of the character used in snow skiing. These types of bindings are generally cumbersome, difficult to use and often fail to provide a type of interconnection between the boots and the snowboard that is essential to the sport of snow boarding.

A substantial improvement in snowboard, boots and bindings is described in U.S. patent and U.S. Pat. No. 6,224,086 B1 issued to the present inventor. The novel apparatus of the invention described in this patent comprises a unique snow boot binding in which only magnetic forces are used to removably affix the snow boot to a ski or snowboard. The apparatus also includes novel means for quickly and easily disconnecting the snow boot from the upper surface of the snowboard or snow ski, which carries the magnetic elements of the apparatus. In one form of the invention this novel release mechanism comprises an easy-to-use, hand-operated lever which enables the skier or the snow-boarder to quickly and easily disconnect the snow boot from the upper surface of the ski or snowboard.

Other recent improvements in snow sport bindings are those described in U.S. Pat. No. 5,558,355 issued to Henry. The Henry patent describes a binding which is particularly suitable for snow boarding and provides an easy-to-use, kick-in boot engagement feature and a number of convenient ways to disengage the boot in a relative small, light-weight, and economical structure. Another type of ski binding is disclosed in U.S. Pat. No. 5,143,397 issued to Stepanek et al. This patent describes a part for a ski binding comprising a carriage slidably attached to a base plate. One end of the base plate is fastened to the ski with fasteners while the other end rests freely on the bottom of a U-shaped clamp also fastened to the ski with fasteners. Attachment of the carriage to the base is accomplished by carriage structural features that retain the carriage in the clamp and further carriage structural features that prevent the carriage from being vertically disengaged from the part of the base adjacent to the base plate fastened end.

Still another improved binding for a snowboard is that described in U.S. Pat. No. 5,143,369 issued to Shaanan et al. The Shaanan et al patent concerns a binding for a snowboard that has a base, side members extending upwardly and rearwardly from the sides of the base with an arcuate member joining the rear ends of the side members. Fastening means on one of the side members and one side edge of the board at the front provide for attachment of one end of two straps. Fastening means on the other side member and on the other side edge serve for attachment of a locking bar, which, in turn, connects the other end of each strap to the side member and base.

The foregoing prior art patents represent some of the more recent attempts to improve the quality of snow boots and bindings particularly for use in connection with snow boarding. While the devices disclosed in the aforementioned patents constitute substantial improvements over the prior art, they nevertheless remain somewhat complicated in design, bulky and, in some cases, difficult to use.

The thrust of the present invention is to overcome the drawbacks of the prior art snow-ski and snow-board boots and bindings and to provide a magnet-carrying boot and binding that is easy to use and one that enables the quick and positive interconnection of the snow boots with the upper surface of the snow-board.

SUMMARY OF THE INVENTION

It is an object of the present invention to provide a universal snow boot and binding for use in connection with either snow skiing or snow boarding which is easy to use and provides quick, easy and positive interconnection of the snow boot with the upper surface of the ski or snow-board. More particularly, it is an object of the invention to provide a highly novel snow boot and binding in which magnetic forces in cooperation with a novel mechanical locking mechanism are used to removably affix the snow boot to the ski or snowboard.

Another object of the invention is to provide an apparatus of the aforementioned character in which the snow boot or foot enclosure carries a permanent magnet while the mechanical locking mechanism is strategically mounted on the snow board.

Another object of the invention is to provide an apparatus as described in the preceding paragraph in which the mechanical locking mechanism includes a toe locking mechanism and a cooperating heel locking mechanism that is easily operable to enable the snow boot to be readily disconnected from the upper surface of the snow-board or snow ski.

Another object of the invention is to provide an apparatus as described in the preceding paragraph in which the heel locking mechanism comprises an easy-to-use, hand-operated lever that enables the skier or the snow-boarder to quickly and easily disconnect the snow boot from the upper surface of the ski or snow-board.

Another object of the invention is to provide an apparatus of the character described in which the snow boot carries a toe locking tab that is removably receivable within a tab receiving locking element carried by the snow board.

Another object of the invention is to provide an apparatus of the character described in the preceding paragraphs which is light-weight, is simple to manufacture and install, and is virtually fail-safe in operation.

Another object of the invention is to provide a novel ski boot and cooperating binding which is compact, lightweight and is of a simple, straight forward construction that and can be inexpensively manufactured.

BRIEF DESCRIPTION OF THE DRAWINGS

FIG. 16 is a fragmentary, top plan view, partly broken away to show internal construction, illustrating the forward portion of the foot enclosure assembly of FIG. 14 in position within the binding assembly shown in FIG. 15.

FIG. 17 is a cross-sectional view taken along lines 17—17 of FIG. 16.

FIG. 18 is a side-elevational, cross-sectional view similar to FIG. 17, but showing the foot enclosure assembly being separated from the binding assembly.

FIG. 22 is a fragmentary, top plan view, partly in section of the alternate form of the apparatus shown in FIGS. 19 and 20.

FIG. 23 is a cross-sectional view taken along lines 23—23 of FIG. 22.

FIG. 24 is a cross-sectional view similar to FIG. 23, but showing the foot enclosure assembly having been moved into a downward, locked position.

FIG. 25 is a cross-sectional view taken along lines 25—25 of FIG. 24.

FIG. 26 is a cross-sectional view similar to FIG. 24, but showing the heel securement means moved into a release position to permit removal of the foot enclosure assembly from the connector frame assembly of the invention.

DESCRIPTION OF THE INVENTION

Figure 1A:
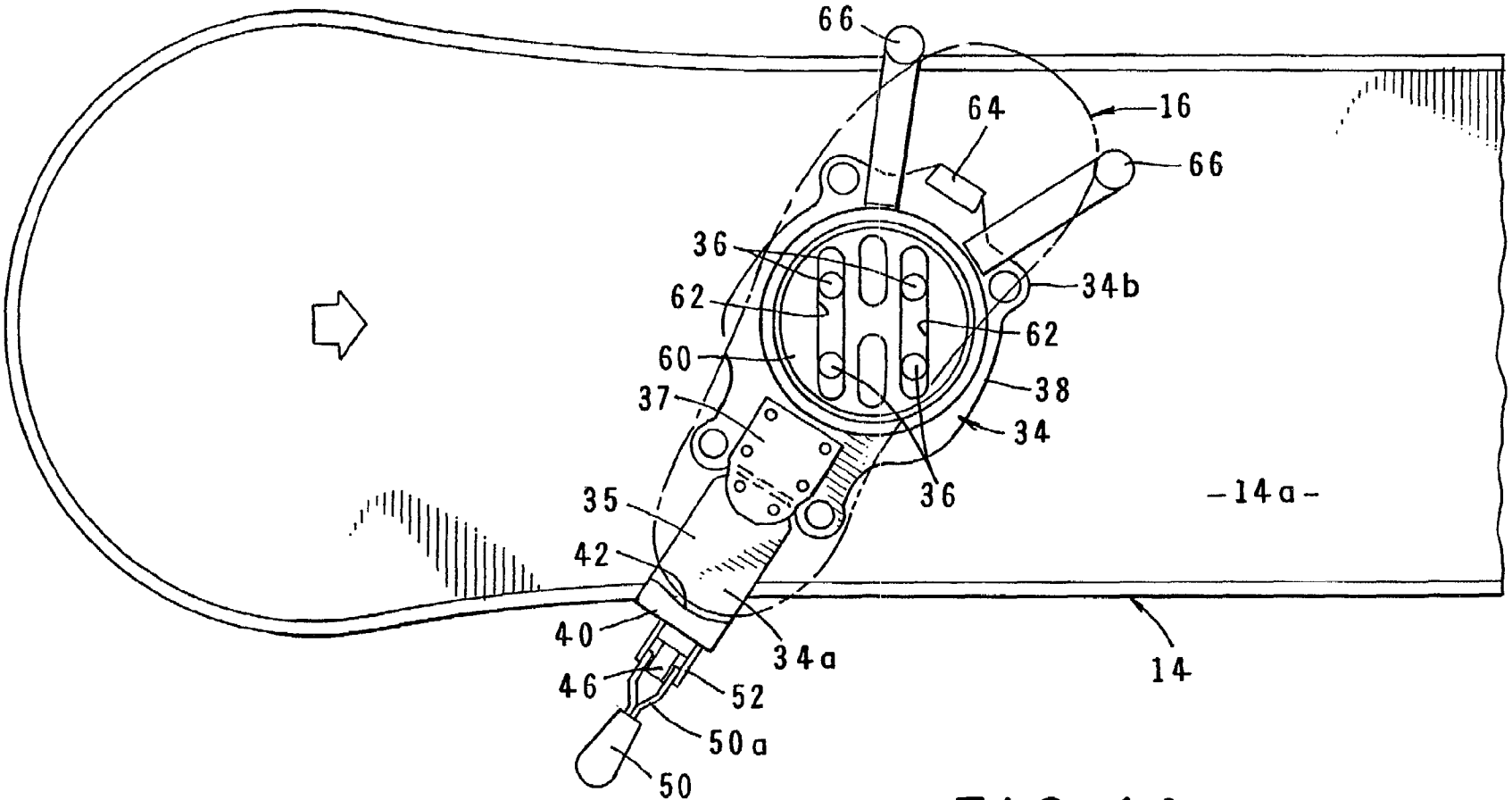
FIGS. 1A and 1B, when considered together, comprise a top plan view of one form of the apparatus of the invention for gliding over the snow.
Figure 1B:
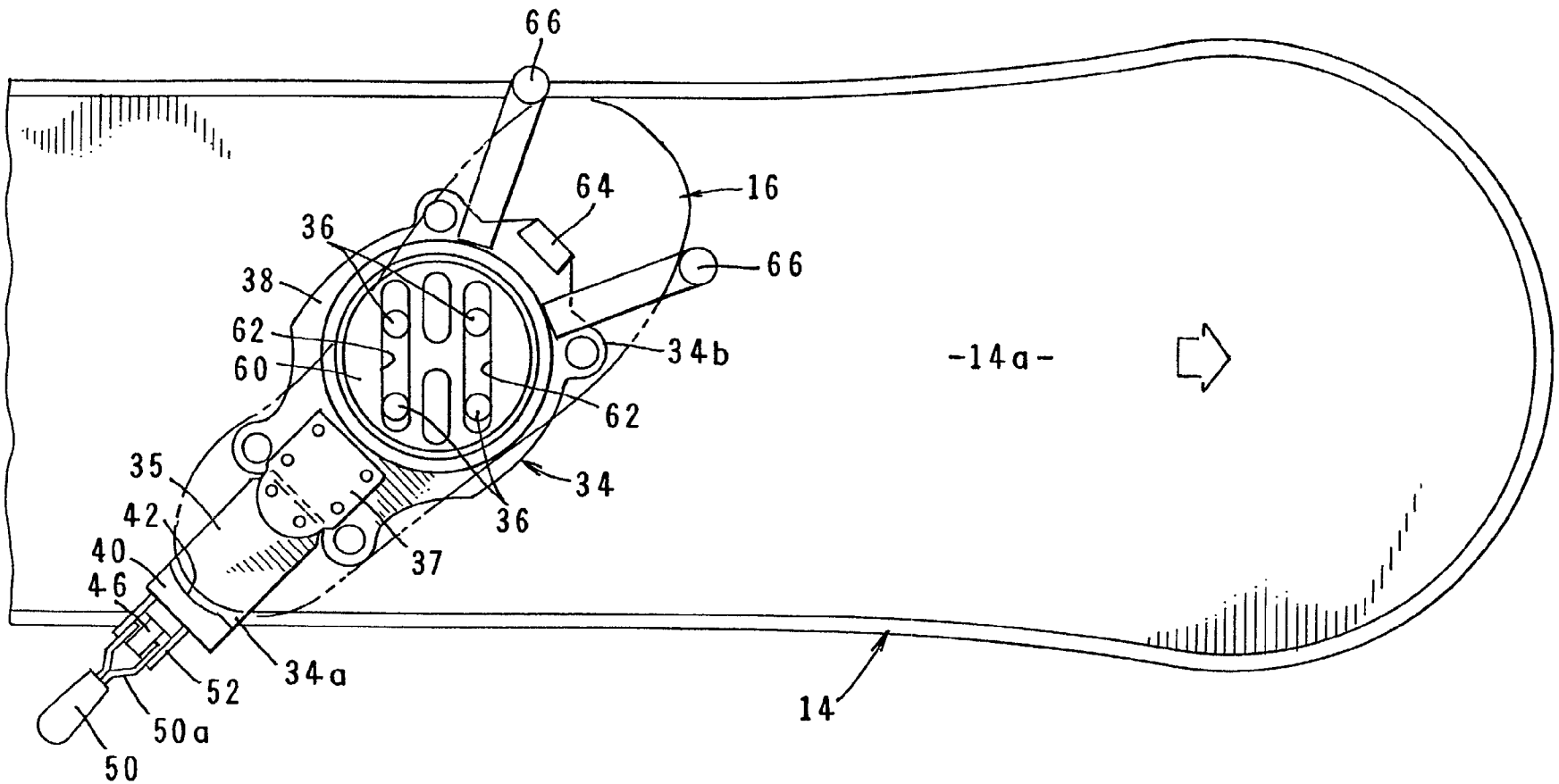

Referring to the drawings and particularly to FIGS. 1 through 13, one form of the apparatus of the invention for gliding over snow is there shown. In this form of the invention, the principal cooperating components comprise a support base 14, a pair of identical foot enclosure assemblies 16, and connector means connected to the support base for releasably interconnecting the foot enclosure assemblies with the support base. Support base 14 includes an upper surface 14*a* and a lower surface 14*b* and, in the form of the invention shown in FIGS. 1 through 13, comprises a snowboard.

Figure 3:
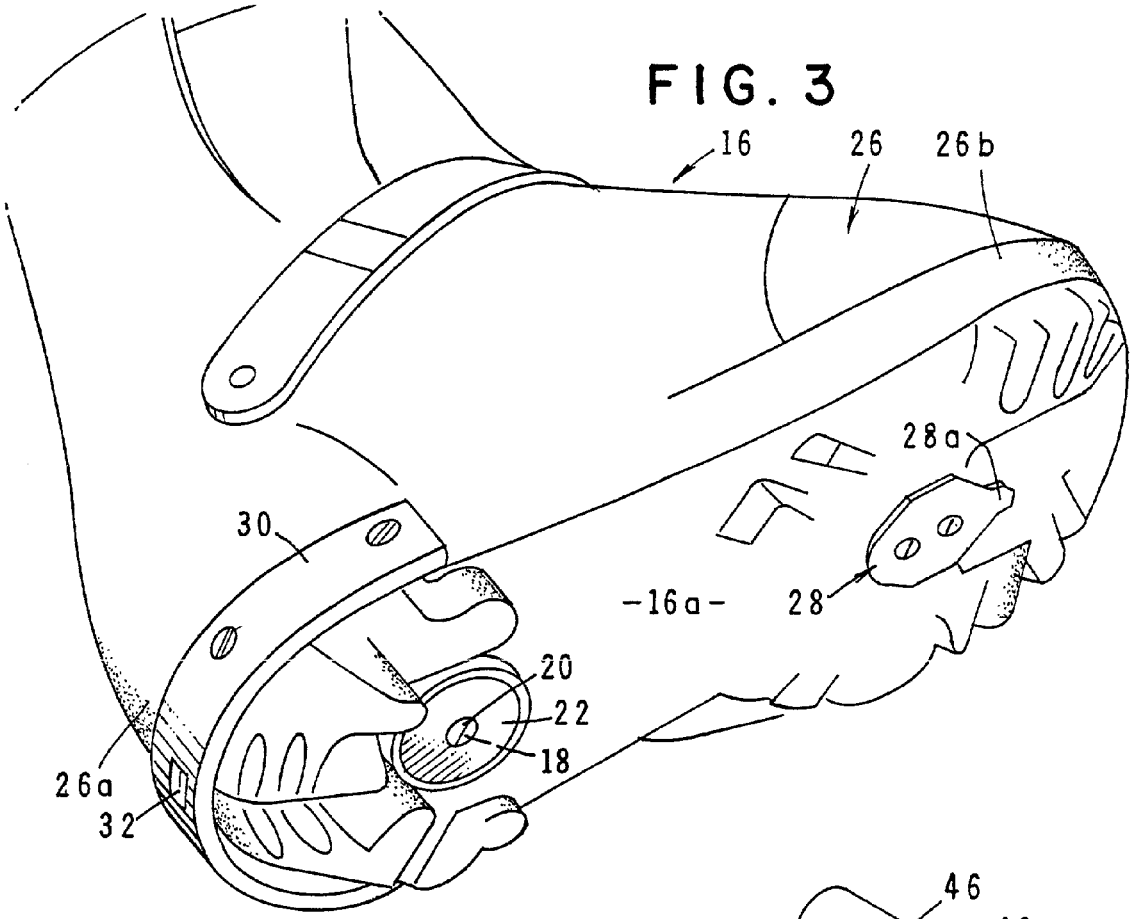
FIG. 3 is a generally perspective bottom view of one form of the foot enclosure assembly of the invention.
Figure 5:
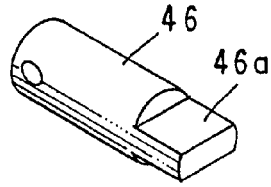
FIG. 5 is a generally perspective view of the locking pin of the assemblage shown in FIG. 4.
Figure 4:
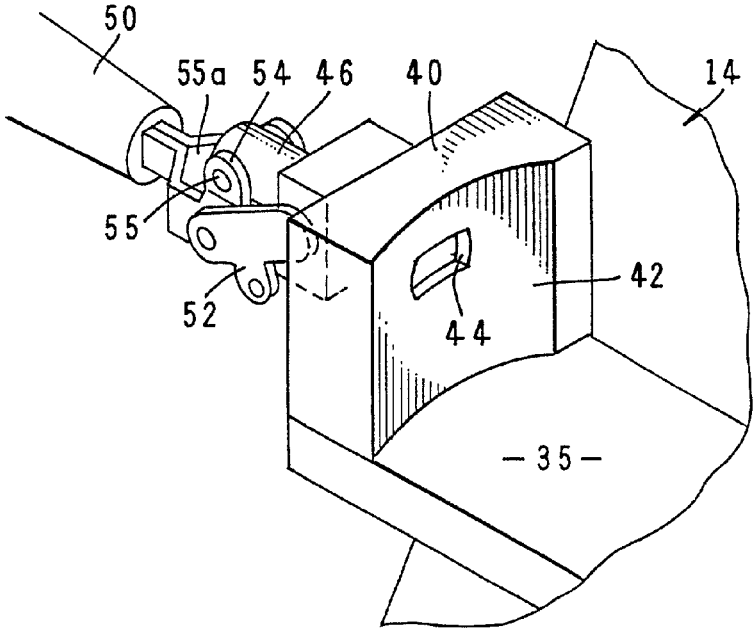
FIG. 4 is a greatly enlarged, generally perspective, fragmentary view of the rear locking portion of the binding assembly shown in FIG. 2.
Figure 7A:
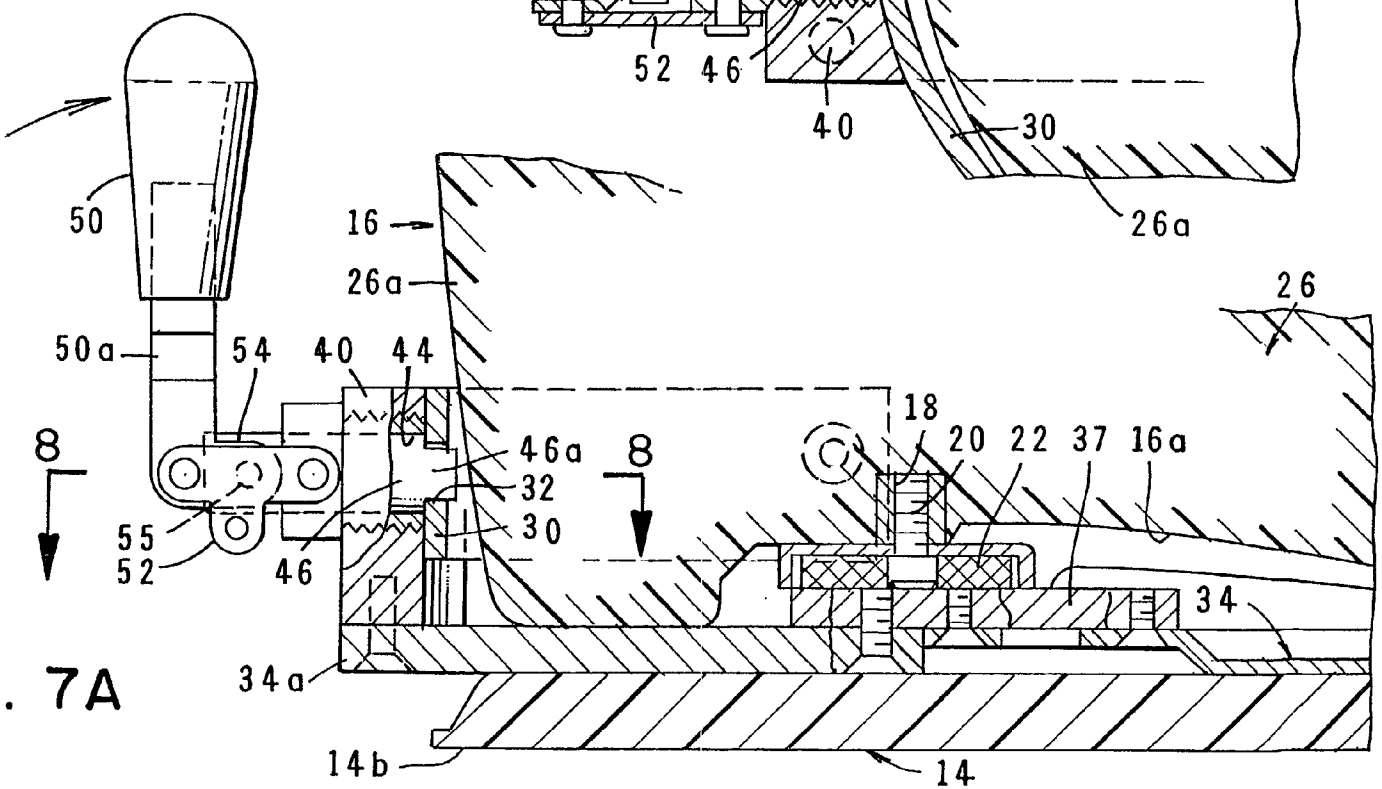
FIGS. 7A and 7B, when considered together, comprise an enlarged cross-sectional view taken along lines 7—7 of FIG. 6.
Figure 9:
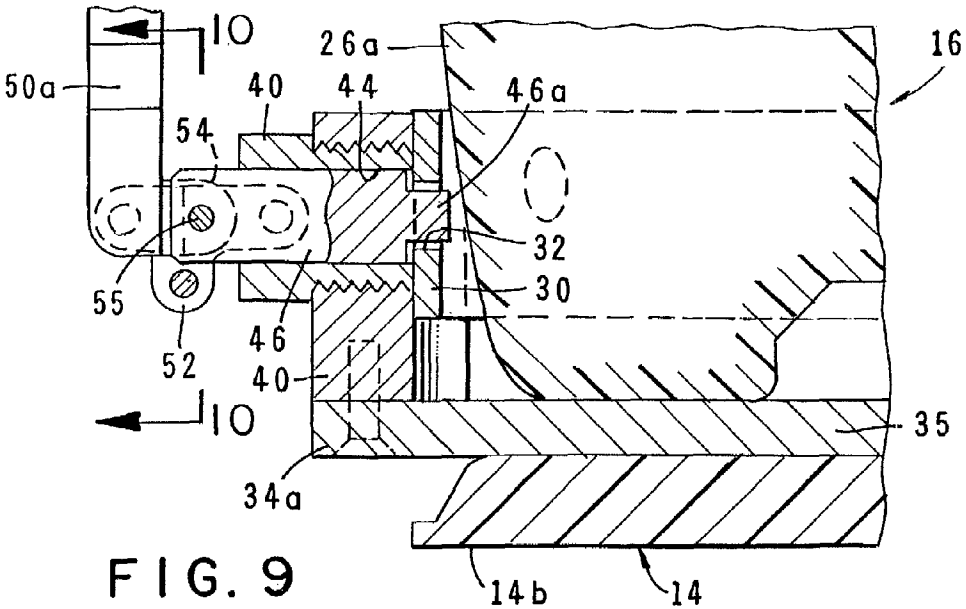
FIG. 9 is a cross-sectional view taken along lines 9—9 of FIG. 8.
Figure 7B:
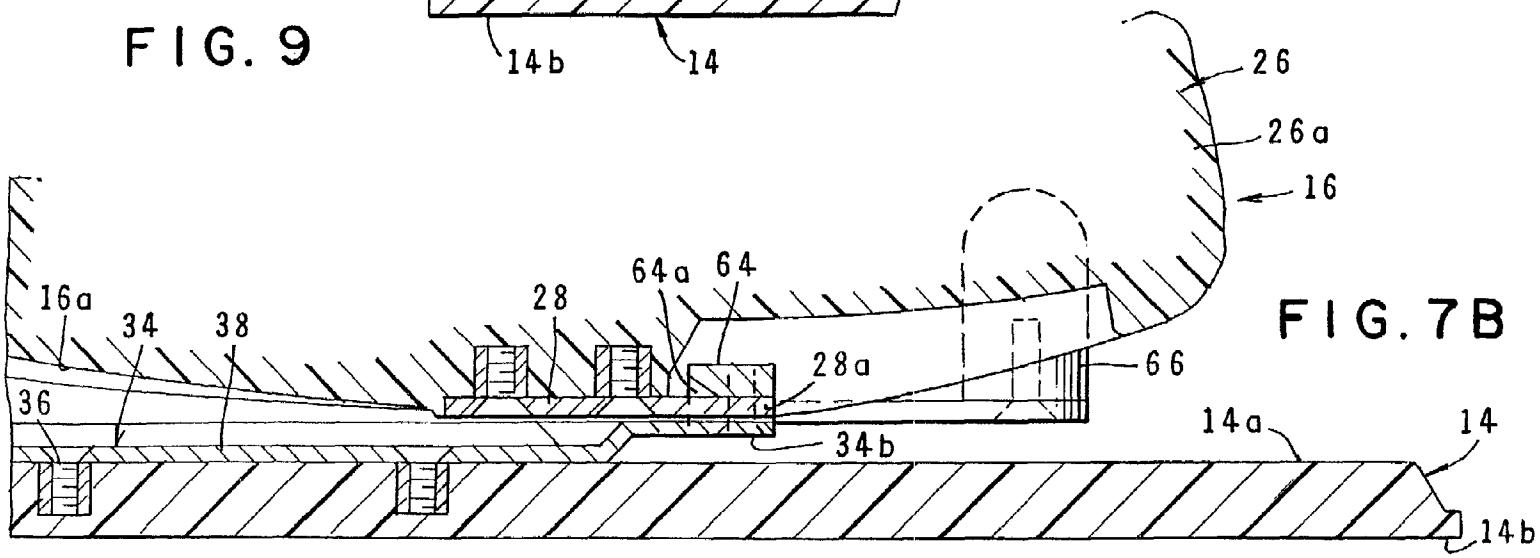
Figure 12:
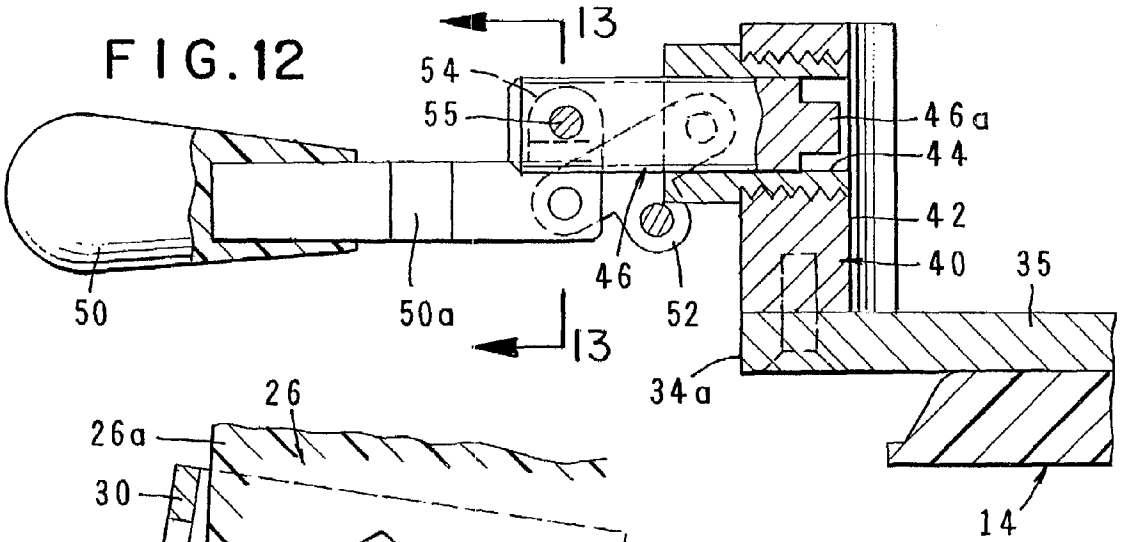
FIG. 12 is a cross-sectional view taken along lines 12—12 of FIG. 11.
Figure 13:
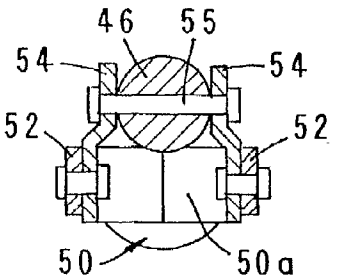
FIG. 13 is a cross-sectional view taken along lines 13—13 of FIG. 12.

As best seen in FIGS. 3 and 7A, the lower surface 16*a* of each of the foot enclosure assemblies is provided with a threaded bore 18 that receives a threaded stud 20 that functions to connect a generally circular shaped permanent magnet 22 with the foot enclosure assembly. Magnet 22 is of a high holding power, compact design, and can be constructed from various materials. By way of example, magnet 22 can comprise powerful ceramic disk, permanent magnet of a character readily commercially available from various sources including A-L-L Magnetics, Inc. of Palencia, Calif. This type of ceramic magnet can be constructed in various configurations and, if desired, can be encased in nickel-plated steel cups. Magnet 22, which is commercially available in a number of different sizes, can range in diameter from about 2 inches to about 3 inches. It is to be understood that in constructing the apparatus of the present invention, a single, relatively large magnet can be used, or in the alternative, a plurality of smaller magnets disposed in a suitable array can be used to provide the magnetic forces necessary to releasably secure the heel portion of the foot enclosure assembly of the apparatus to the support base.

Referring to FIGS. 3, 6, 7A and 7B the foot enclosure assembly 16 of the present invention can be seen to comprise a snow boot-like foot enclosure 26 having a heel portion 26*a* and a toe portion 26*b*. As best seen in FIG. 3 magnet 22 is affixed to the lower surface of the foot enclosure means intermediate the heel portion and the toe portion. For a purpose presently to be described, a toe locking member 28 having an outwardly extending locking tab 28*a* is affixed to the lower surface of the foot enclosure means proximate the toe portion. Also affixed to the lower surface of the foot enclosure means proximate the heel portion thereof is foot enclosure locking means for releasably locking the heel portion of the foot enclosure means to support base 14. This means here comprises a generally "U" shaped heel-locking member 30 having an opening or bore 32 therethrough.

Figure 2:
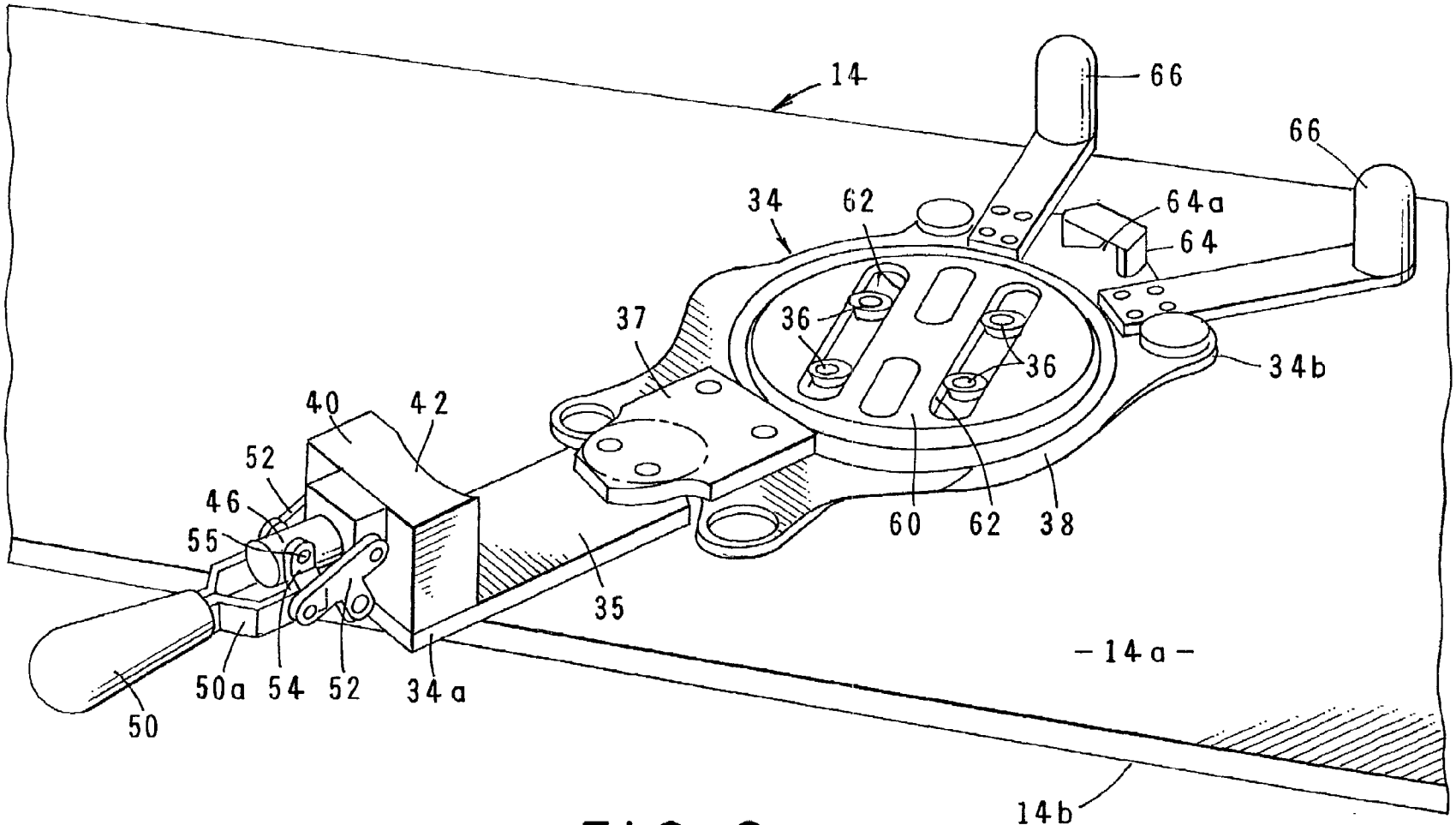
FIG. 2 is a greatly enlarged, generally perspective view of one of the binding apparatus of the invention for releasably connecting the foot enclosure assembly of the invention to the support base.

Turning to FIG. 2, one of the two identical connector means of the invention for releasably interconnecting the entire foot enclosure assemblies 16 with the support base 14 can be seen to comprise an elongated frame-like assembly 34 having a first end 34*a* and a second end 34*b*. Each of the assemblies 34 is adjustably connected to support base 14 by two sets of threaded connectors 36.

Affixed to each of the frame assemblies intermediate the first and second ends thereof is a ferrous metal plate 36 that is engageable by magnets 22 when the foot enclosure assemblies 16 are mated with the frame assemblies in a manner presently to be described. The ferrous metal plates 36 comprise a part of the heel securement means of the invention for securing the heel portion of the foot enclosure assemblies 16 within their respective frame assemblies.

Figure 8:
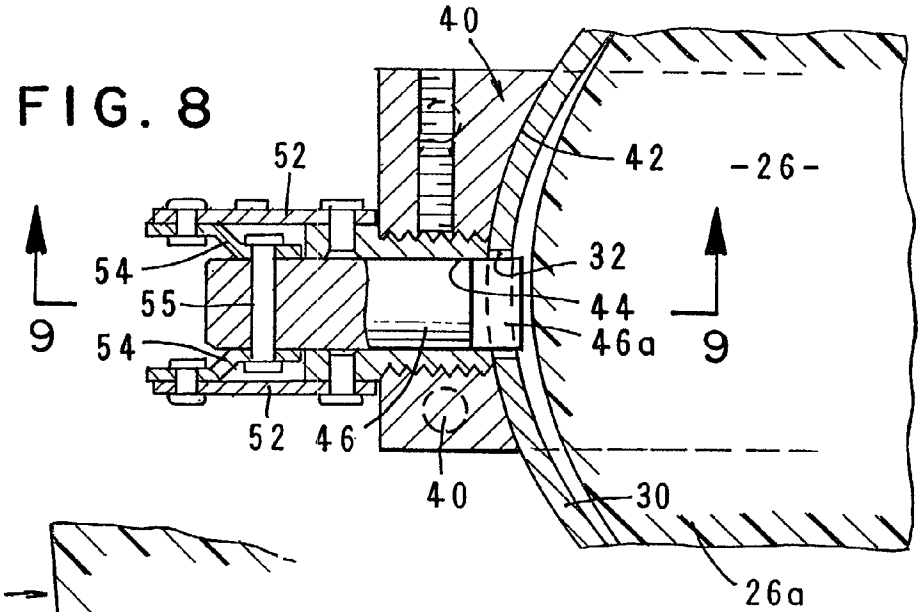
FIG. 8 is a cross-sectional view taken along lines 8—8 of FIG. 7A.

The heel securement means of the invention also includes heel locking means for locking engagement with the heel portion of one of the foot enclosure assemblies 16. Each of the identical heel locking means here comprises an upstanding heel-receiving block 40 that is connected to base portion 35 of its respective frame assembly 34. Block 40 has a concave surface 42 and a bore 44 therethrough for telescopically receiving the locking tongue end portion 46*a* of an elongated, generally cylindrically shaped locking pin 46 that is carried by block 40. (See FIGS. 4, 5, 7A, 8 and 9). Also comprising a part of the heel locking means of the present invention is finger gripping means that includes a finger gripping lever 50 having a yoke portion 50*a* that is pivotally connected to heel receiving block 40 and to locking pin 46 by means of connecting links 52 and 54 respectively. As best seen in FIG. 8, a transverse pin 55 interconnects link 54 with locking pin 46. With this construction, lever 52 can be moved between the upward, boot locking position shown and FIGS. 7A and 9, wherein end 46*a* of the locking pin is received within opening 32 of locking member 30 and the downward release position shown in FIGS. 2, 4, 10A and 12 wherein the end of the locking pin is retracted from opening 32.

As is also shown in FIG. 2, each frame assembly 34 includes a generally disk shaped connector member 60 that is rotatably mounted within a central opening 63 formed in base portion 37. Connector member 60 comprises a part of the adjustment means of the invention for adjustably interconnecting the frame assemblies 34 with support base 14. More particularly, by loosening threaded connectors 36, the frame assembly can be rotated relative to connector 60 in a manner to vary the angle of the frame assembly with respect to support base 14. Similarly, connector member 60 is provided with a pair of spaced apart parallel slots 62 that receive threaded connectors 36. With this construction, by loosening threaded connectors 36, each connector member 60 can be moved transversely of the support base to adjust the transverse position of frame assembly 34 on the upper surface 14*a* on support base 14.

Figure 6:
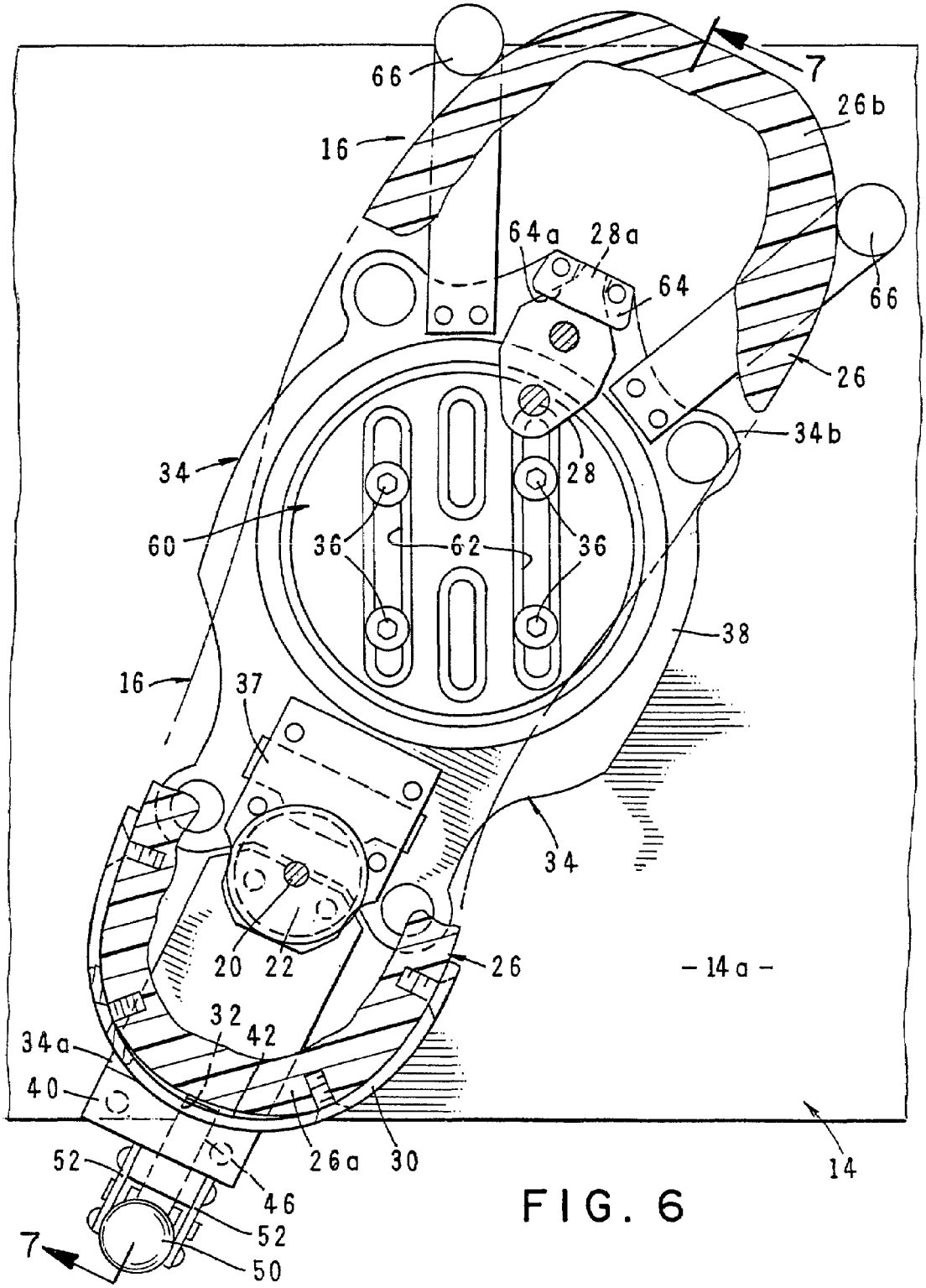
FIG. 6 is a top plan view partly broken away to show internal construction of one of the foot enclosure assemblies that is interconnected with one of the binding assemblies of the character shown in FIG. 2.

The connector means of the present form of the invention further comprises toe-securement means for securing the toe portion of foot enclosures 16 within their respective frame assemblies 34. Each of the identical toe locking means here comprises an upstanding locking element or bracket 64 that is connected to the frame assembly proximate second end 34*b* thereof (FIG. 2). Bracket 64 is provided with an opening 64*a* that closely receives locking tab 28*a* of toe locking member 28 when a foot enclosure 16 is positioned within a frame assembly 34 in the manner shown in FIG. 6. In this regard, to initially correctly position the foot enclosures 16 within the frame assemblies 34, positioning means are provided on each of the frame assemblies proximate end 34*b* thereof. As shown in FIG. 6, these positioning means here comprise a pair of upstanding locating pins 66 that are engageable by the forward portion of foot enclosure assembly 16 when the foot enclosure assembly is properly positioned within its respective frame 34 with the locking tab 28*a* thereof correctly positioned within opening 64*a* of bracket 64.

Figure 10:
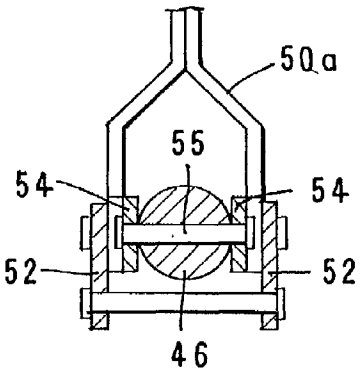
FIG. 10 is a cross-sectional view taken along lines 10—10 of FIG. 9.
Figure 10A:
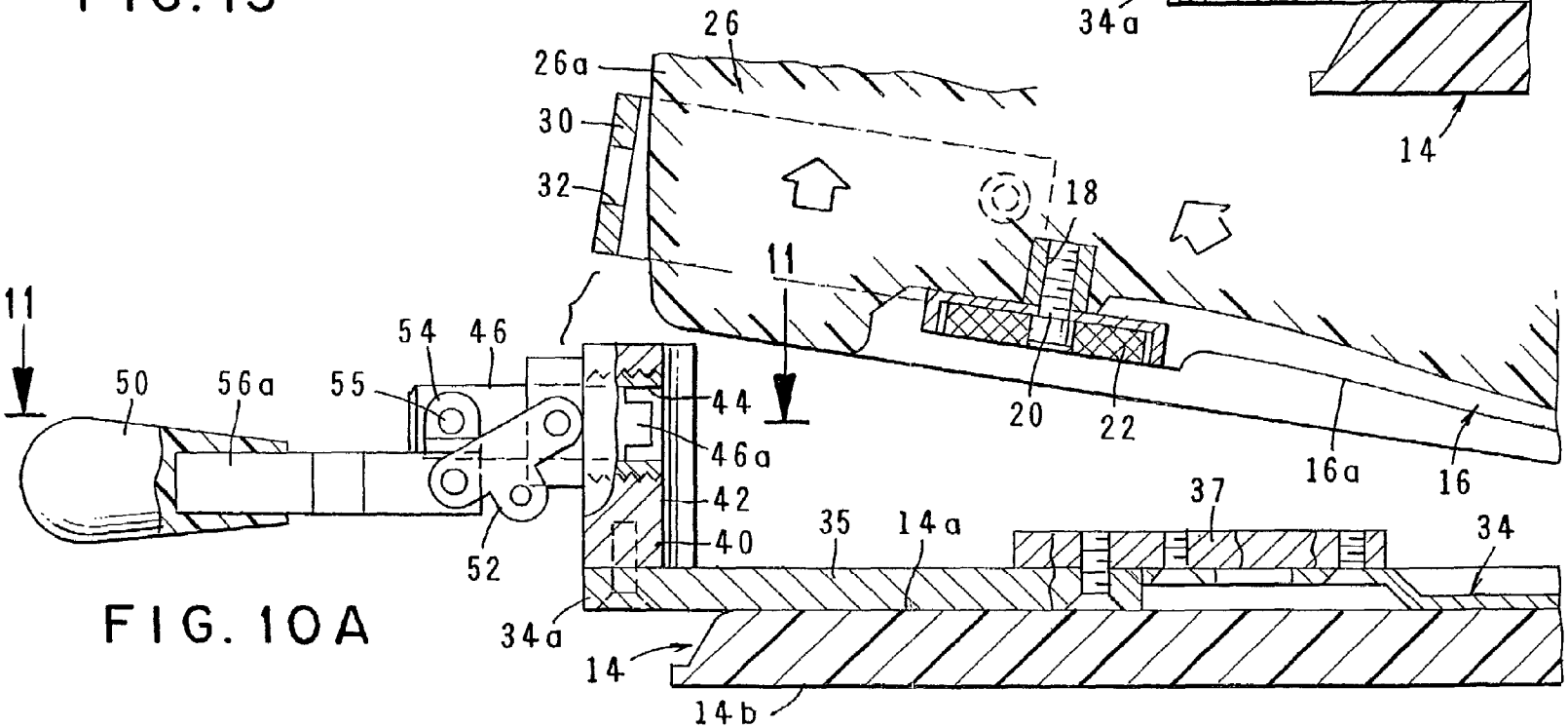
FIGS. 10A and 10B, when considered together comprise a side-elevational, cross-sectional view similar to FIGS. 7A and 7B but showing the foot enclosure assembly of the invention being separated from the clamping assembly.
Figure 11:
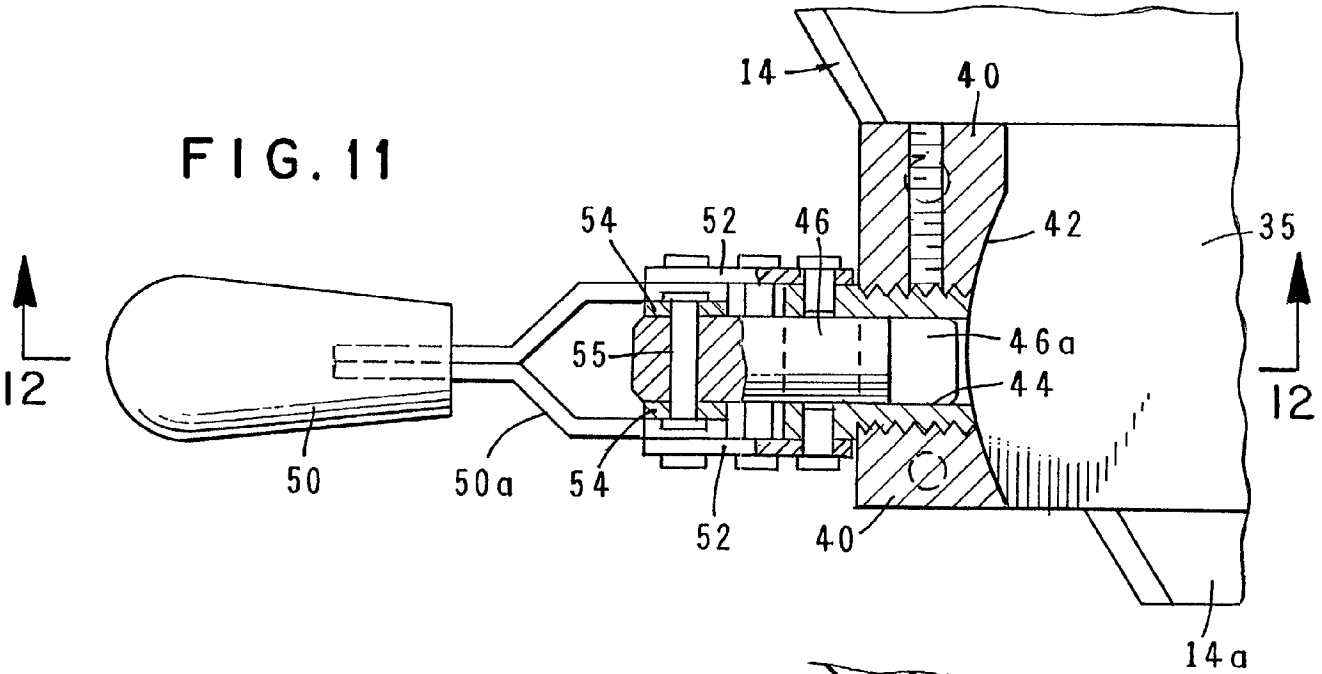
FIG. 11 is a cross-sectional view taken along lines 11—11 of FIG. 10A.
Figure 10B:
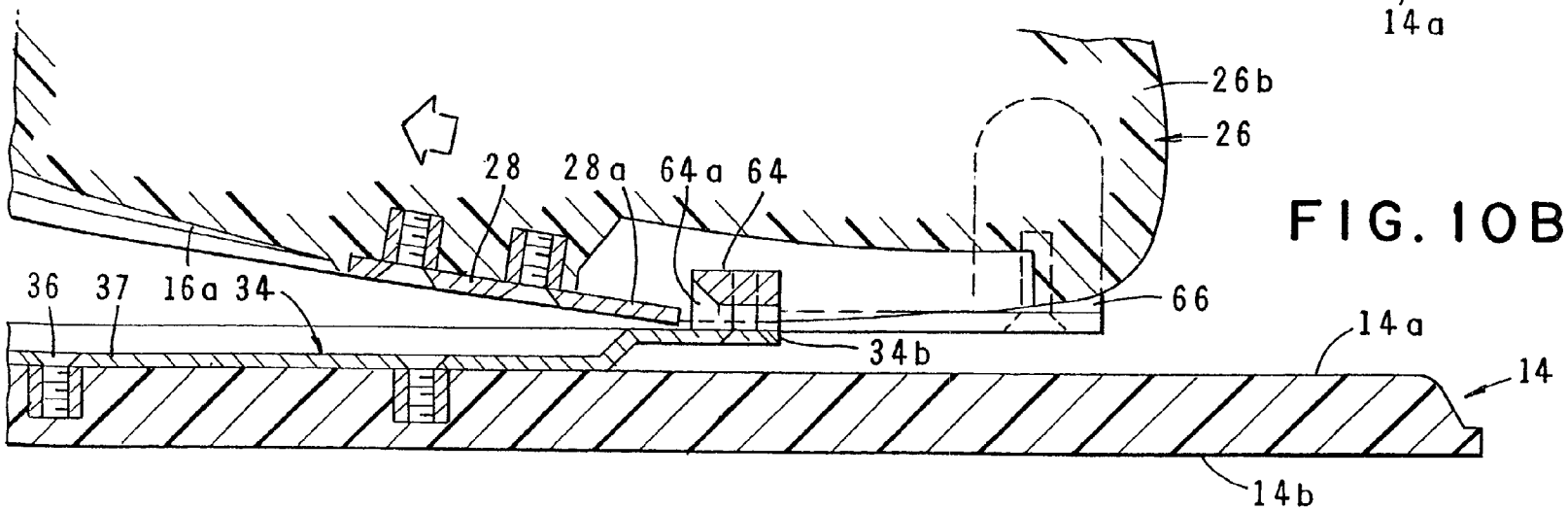

The foot enclosures can be removed from their respective frame assemblies in the manner illustrated in FIGS. 10A and 10B. More particularly, by moving lever 50 into the downward position shown in an FIG. 10A, the user can lift the heel of the foot enclosure upwardly in the direction of the arrows of FIG. 10A against the urging of magnet 22 so that the heel portion moves free of the frame assembly. This done, the user can move the foot enclosure rearwardly in the direction of the arrow of FIG. 10B so that tab 28*a* of the toe locking member slides free of the locking element 64. To interconnect the foot enclosure with the frame assembly, the reverse procedure is, of course, followed.

Turning now to FIGS. 14 through 18, an alternate form of the apparatus of the invention for gliding over snow is there shown. This form of the invention is similar in many respects to that shown in FIGS. 1 through 13 and like numerals are used in FIGS. 14 through 18 to identify like components. As in the earlier described embodiment of the invention, the principal cooperating components of this latest embodiment comprise a support base 14, a pair of foot enclosure assemblies 70, and connector means connected to the support base for releasably interconnecting the foot enclosure assemblies with the support base.

Figures 14, 15:
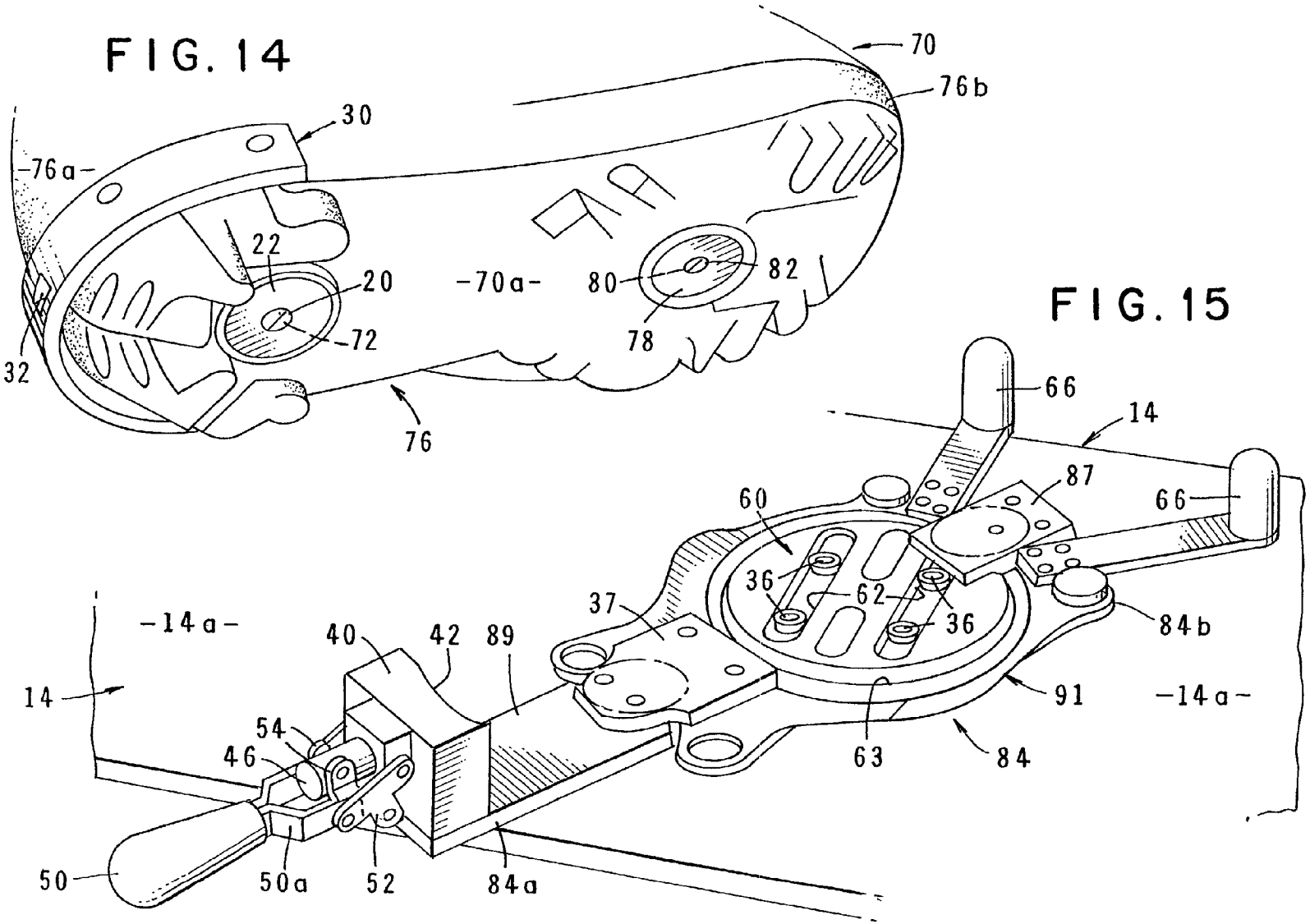
FIG. 14 is a generally perspective bottom view of an alternate form of foot enclosure assembly of the invention.
FIG. 15 is a generally perspective view of an alternate form of binding assembly of the apparatus of the invention.
Figure 19:
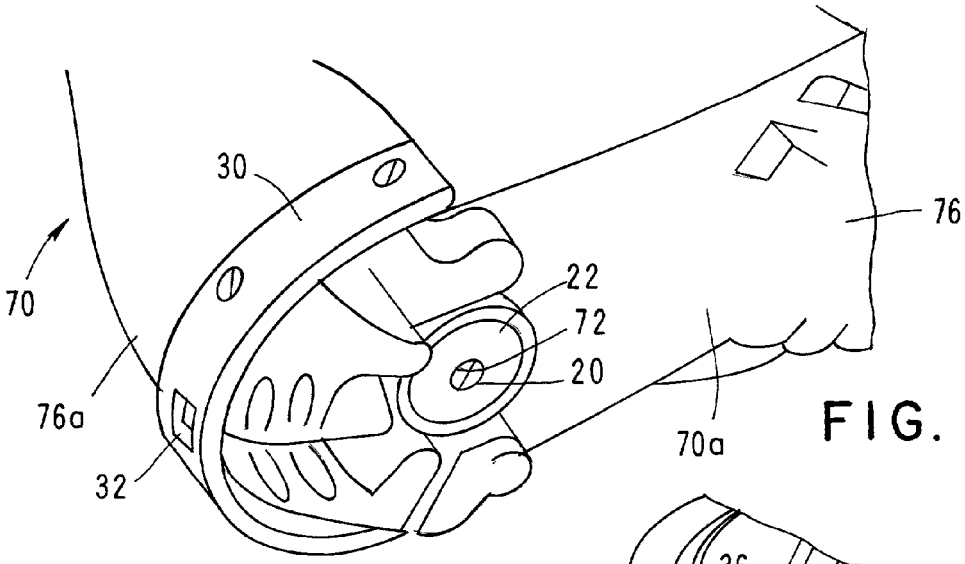
FIG. 19 is a generally perspective, fragmentary view of a foot enclosure assembly of an alternate form of the apparatus of the invention for gliding over the snow.
Figure 20:
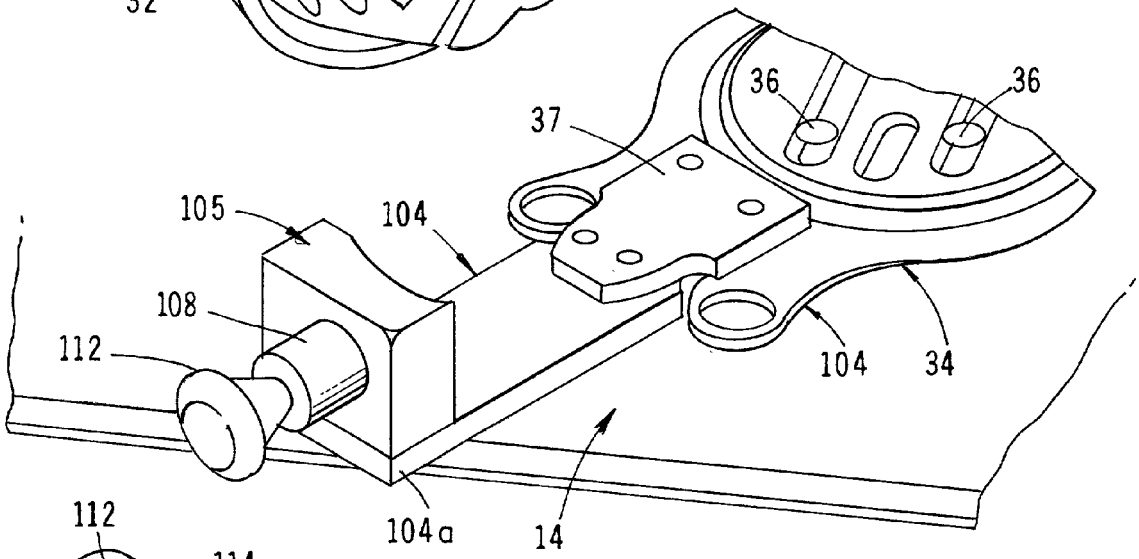
FIG. 20 is a generally perspective, fragmentary view of the connector means of the alternate form of apparatus of the invention for gliding over the snow.

As best seen in FIG. 14, the lower surface 70*a* of the foot enclosure assembly is provided with a threaded bore 72 that receives a threaded stud 20 that functions to connect a generally circular shaped permanent magnet 22 with the foot enclosure assembly. Magnet 22 is of the character previously described and can comprise a powerful ceramic disk, permanent magnet of a character readily commercially available from various sources including A-L-L Magnetics, Inc. of Palencia, Calif.

Referring to FIGS. 14, 16, 17 and 18, each of the identical foot enclosure assemblies 70 of the present invention can be seen to comprise a snow boot-like foot enclosure 76 having a heel portion 76*a* and a toe portion 76*b*. As best seen in FIG. 14, magnet 22 is affixed to the lower surface of the foot enclosure means intermediate the heel portion and the toe portion. For a purpose presently to be described, a second magnet 78 is affixed to the lower surface of the foot enclosure means proximate the toe portion. As illustrated in FIGS. 14 and 17, the foot enclosure assembly is provided with a second threaded bore 80 that receives second threaded stud 82 that functions to connect the generally circular shaped permanent magnet 78 with the foot enclosure assembly. Magnet 78 also comprises a powerful ceramic disk, permanent magnet of a character readily commercially available from various sources including A-L-L Magnetics, Inc. of Palencia, Calif. Also affixed to the foot enclosure means proximate the heel portion thereof is a generally "U" shaped heel-locking member 30 having an opening or bore 32 therethrough.

The important connector means of this latest form of the invention for releasably interconnecting the foot enclosure assemblies 70 with the support base 14 comprises a pair of identical, elongated frame-like assemblies 84, one of which is shown in FIG. 15. This assembly has a first end 84*a*, a second end 84*b* and is adjustably connected to support base 14 by two sets of threaded connectors 36. Affixed to each of the frame assemblies intermediate it's first and second ends is a ferrous metal plate 37 that is engageable by a magnet 22 when the foot enclosure assembly 70 is mated with the frame assembly in a manner presently to be described. Also affixed to the frame assembly intermediate the first and second ends is a second ferrous metal plate 87 that is engageable by magnet 78 when the foot enclosure assembly 70 is mated with the frame assembly in a manner shown in FIG. 17. Ferrous metal plate 87 here comprises a part of the toe securement means of this latest form of the invention for securing the toe portion of the foot enclosure within the frame assembly. Like frame assembly 34, frame assembly 84 comprises two interconnected base portions 89 and 91 and is adjustably interconnected with support 14 in the manner previously described.

Affixed to each frame assembly 84 proximate the heel end 84*a* is a heel locking means for locking engagement with the heel portion of said foot enclosure assembly and more particularly with locking member 30. This important heel locking means is identical in construction and operation that described in connection with the embodiment of the invention shown in FIGS. 1 through 13 and comprises an upstanding heel-receiving block 40 that is connected to base portion 89. Block 40 has a bore 44 therethrough for telescopically receiving the locking tongue end portion 46*a* of an elongated, generally cylindrically shaped locking pin 46. (See FIGS. 4, 5, 7A, 8 and 9).

Also comprising a part of the heel locking means of the invention is finger gripping means that includes a finger gripping lever 50 having a yoke portion 50*a* that is pivotally connected to heel receiving block 40 and to locking pin 46 by means of connecting links 52 and 54 in the manner previously described. This heel locking means functions in the identical manner previously described.

As is also shown in FIG. 15, each frame assembly 84 includes a generally disk shaped connector member 60 that is rotatably mounted within a central opening 63 formed in base portion 91. Connector member 60 comprises a part of the adjustment means of the invention for adjustably interconnecting the frame assembly 84 with support base 14 in an identical manner to that described in the embodiment shown in FIGS. 1 through 13. More particularly, by loosening threaded connectors 36, the frame assembly can be rotated relative to connector 60 in a manner to vary the angle of the frame assembly with respect to support base 14. Similarly, connector member 60 is provided with a pair of spaced apart parallel slots 62 that receive threaded connectors 36. With this construction, by loosening threaded connectors 36, connector member 60 can be moved transversely of the support base to adjust the transverse position of frame assembly 34 on the upper surface 14*a* on support base 14.

The foot enclosures can be removed from their respective frame assemblies in the manner previously discussed and as illustrated in FIGS. 17 and 18. More particularly, by moving lever 50 into the downward position shown in FIGS. 10A and 15, the user can lift the heel of the foot enclosure upwardly in the direction of the arrows of FIG. 10A so that the heel portion moves free of the frame assembly. This done, the user can move the toe portion of the foot enclosure upwardly in the direction of the arrow of FIG. 18 so that the toe locking member, or second magnet 78 releases from metal plate 87 in the manner shown.

Turning next to FIGS. 19 through 26, still another form of the apparatus of the invention for gliding over snow is there shown. This form of the invention is similar in many respects to the embodiments previously described and like numerals are used in FIGS. 19 through 26 to identify like components. As in the earlier described embodiments of the invention, this latest embodiment comprises three principal cooperating components, namely, a support base 14, a foot enclosure assembly 70, and connector means connected to the support base for releasably interconnecting the foot enclosure assembly with the support base. As before, the lower surface 70*a* of the foot enclosure assembly is provided with a threaded bore 72 that receives a threaded stud 20 that functions to connect a generally circular shaped permanent magnet 22 with the foot enclosure assembly. Magnet 22 is of the character previously described and can comprise a powerful ceramic disk, permanent magnet.

The foot enclosure assembly 70 of this latest form of the invention is identical in form and function to that previously described and comprises a snow boot-like foot enclosure 76 having a heel portion 76*a* and a toe portion. A magnet 22 is affixed to the lower surface of the foot enclosure means intermediate the heel portion and the toe portion and a toe locking means, of the character previously described is affixed to the lower surface of the foot enclosure means proximate the toe portion (not shown).

Also affixed to the lower surface of the foot enclosure means proximate the heel portion thereof is a generally "U" shaped heel-locking member 30 having an opening or bore 32 therethrough.

Figure 21:
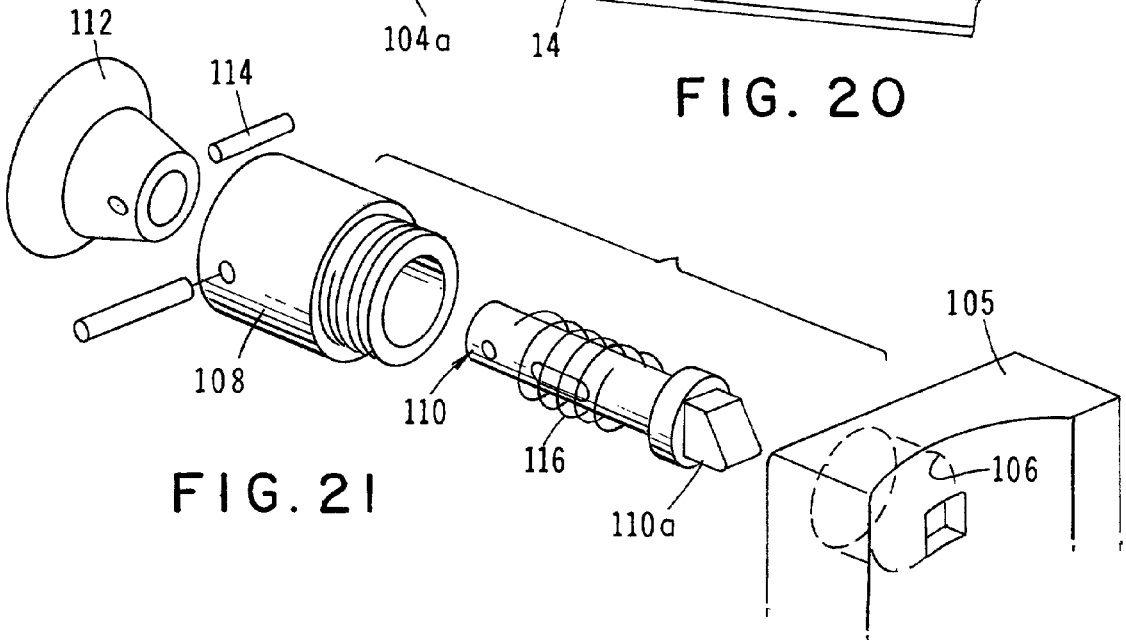
FIG. 21 is a greatly enlarged, generally perspective exploded view of the heel-securement means of the apparatus of the invention shown in FIGS. 19 and 20.

Turning particularly to FIG. 21, the important connector means of this latest form of the invention for releasably interconnecting the foot enclosure assembly 70 with the support base 14 can be seen to comprise an elongated frame-like assembly 104 having a first end and a second end 104*a* that includes a heel block 105 having an internally threaded opening 106 (FIG. 23). Heel block 105 functions to position the foot enclosure assemblies within frame-like assembly 104. Assembly 104 is adjustably connected to support base 14 in the manner previously described by two sets of threaded connectors 36. Affixed to the frame assembly intermediate the first and second ends is a ferrous metal plate 37 that is engageable by magnet 22 when the foot enclosure assembly 70 is mated with the frame assembly. Also affixed to the frame assembly intermediate the first and second ends is a second ferrous metal plate 87 that is engageable by the second magnet 78 when the foot enclosure assembly 70 is mated with the frame assembly (see FIGS. 14 and 15).

Affixed to frame assembly 104 proximate the heel end 104*a* is a heel locking means for locking engagement with the heel portion of said foot enclosure assembly. This important heel locking means comprises a hollow housing 108 that is threadably connected to threaded opening 106 (FIG. 23) and a locking pin 110 mounted within hollow housing 108. Locking pin 110 includes a tapered locking tongue 110*a* that is telescopically receivable within the opening 32 formed in heel locking member 30. Connected to locking pin 110 for moving the locking pin relative to opening 32 is finger gripping means shown here as a pull knob 112 that is connected to locking pin 110 by a pair of transverse connector pins 114. Also comprising a part of the heel locking means of this latest form of the invention is biasing means for continuously urging locking pin 110 toward the locked position. As best seen in FIG. 21, this biasing means is here provided as a coil spring 116.

In using this latest form of the invention, a selected foot enclosure assembly can be removed from its frame assembly by pulling rearwardly on pull knob 112 to move the tongue 110*a* of the locking pin out of opening 32 of "U" shaped heel-locking member 30 (FIG. 26). This done, the user can lift the heel of the foot enclosure upwardly against the urging of magnet 22 so that the heel portion moves free of the frame assembly. Next, the user can move the forward portion foot enclosure assembly upwardly so that magnet 78 separates from plate 87. To interconnect the foot enclosure with the frame assembly, the reverse procedure is, of course, followed (see FIGS. 23 and 24).

Referring now to FIGS. 27A through 35B, yet another form of the apparatus of the invention for gliding over snow is there shown. This form of the invention is also similar in many respects those previously described and like numerals are used in FIGS. 27A through 35B to identify like components. As in the earlier described embodiments of the invention, this latest embodiment comprises three principal cooperating components, namely, a support base 14, a foot enclosure assembly 120 (FIG. 29), and connector means connected to the support base for releasably interconnecting the foot enclosure assembly with the support base.

Figure 29:
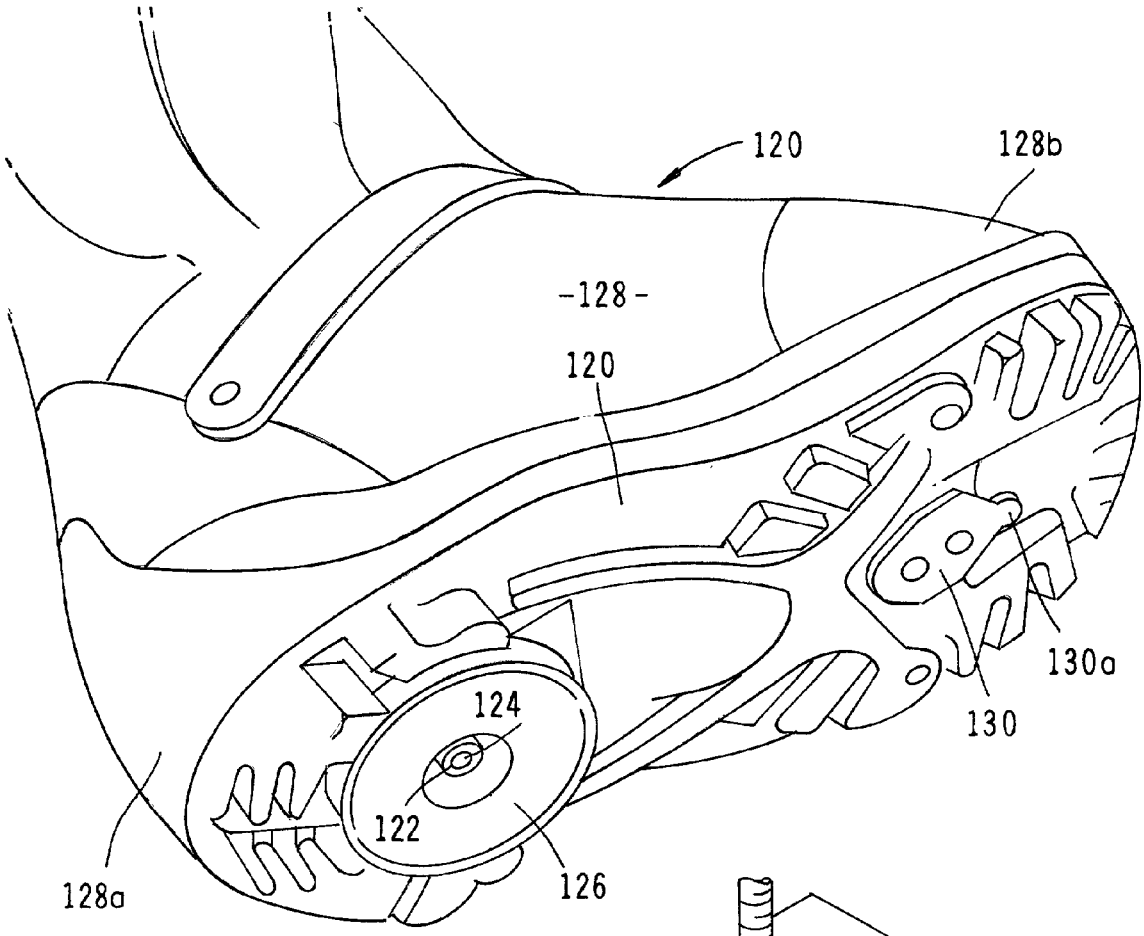
FIG. 29 is a generally perspective, bottom view of the foot enclosure assembly of the alternate form of the invention shown in FIGS. 27A, 27B, and 28.
Figure 30:
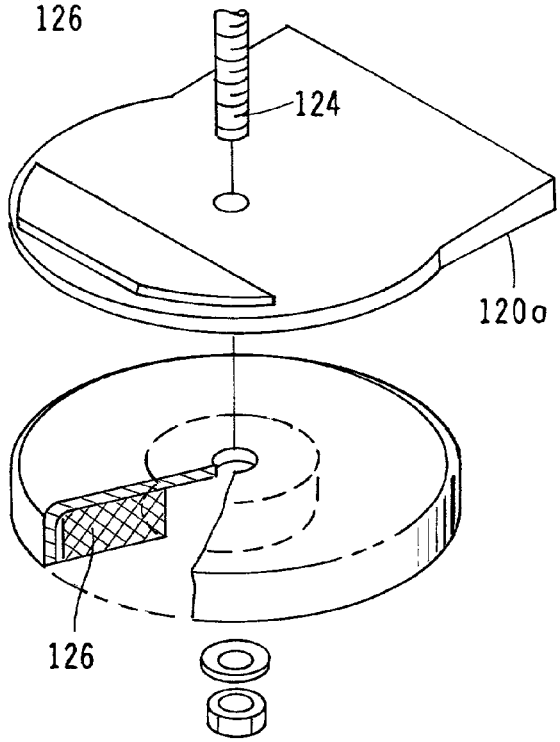
FIG. 30 is an enlarged, generally perspective, exploded view of the magnet means of the foot enclosure assembly shown in FIG. 29 of the drawings illustrating the assembly of the magnet means with the foot enclosure assembly.
Figure 31:
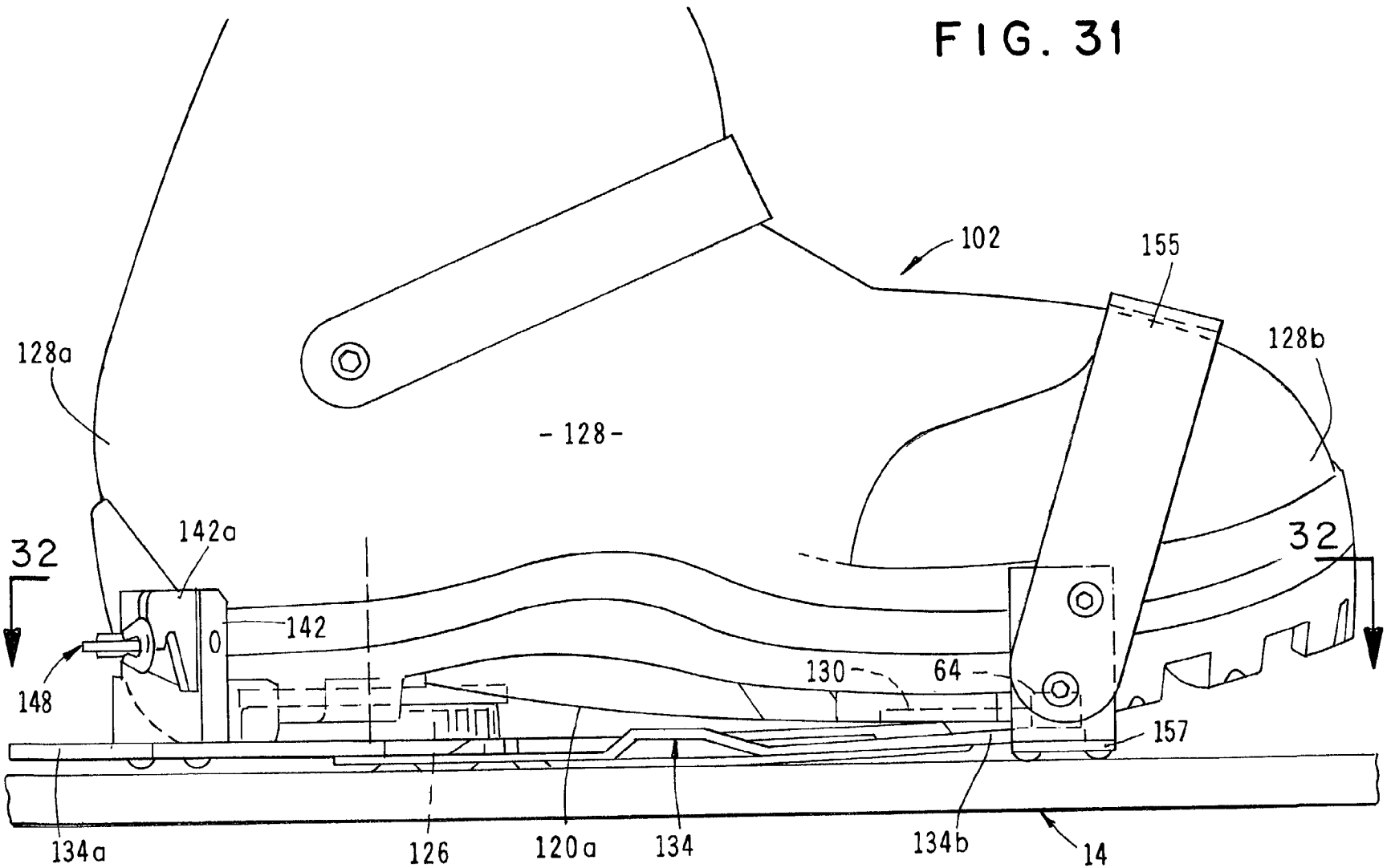
FIG. 31 is an enlarged, side elevational view showing the foot enclosure assembly of the latest form of the invention interconnected with the connector means of the latest form of the invention.
Figure 34:
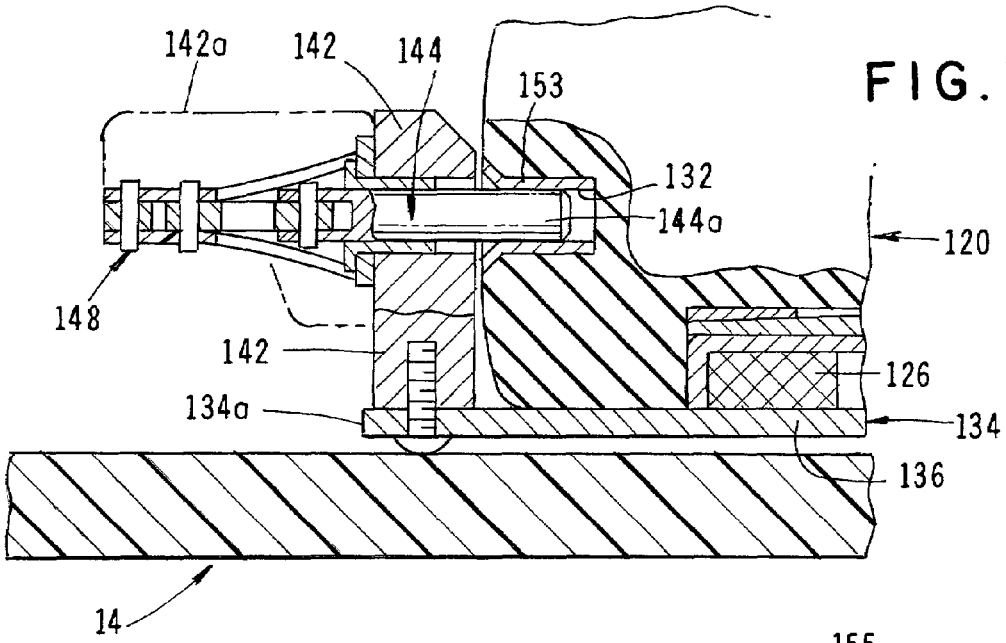
FIG. 34 is a cross-sectional view taken along lines 34—34 of FIG. 32A.
Figure 35B:
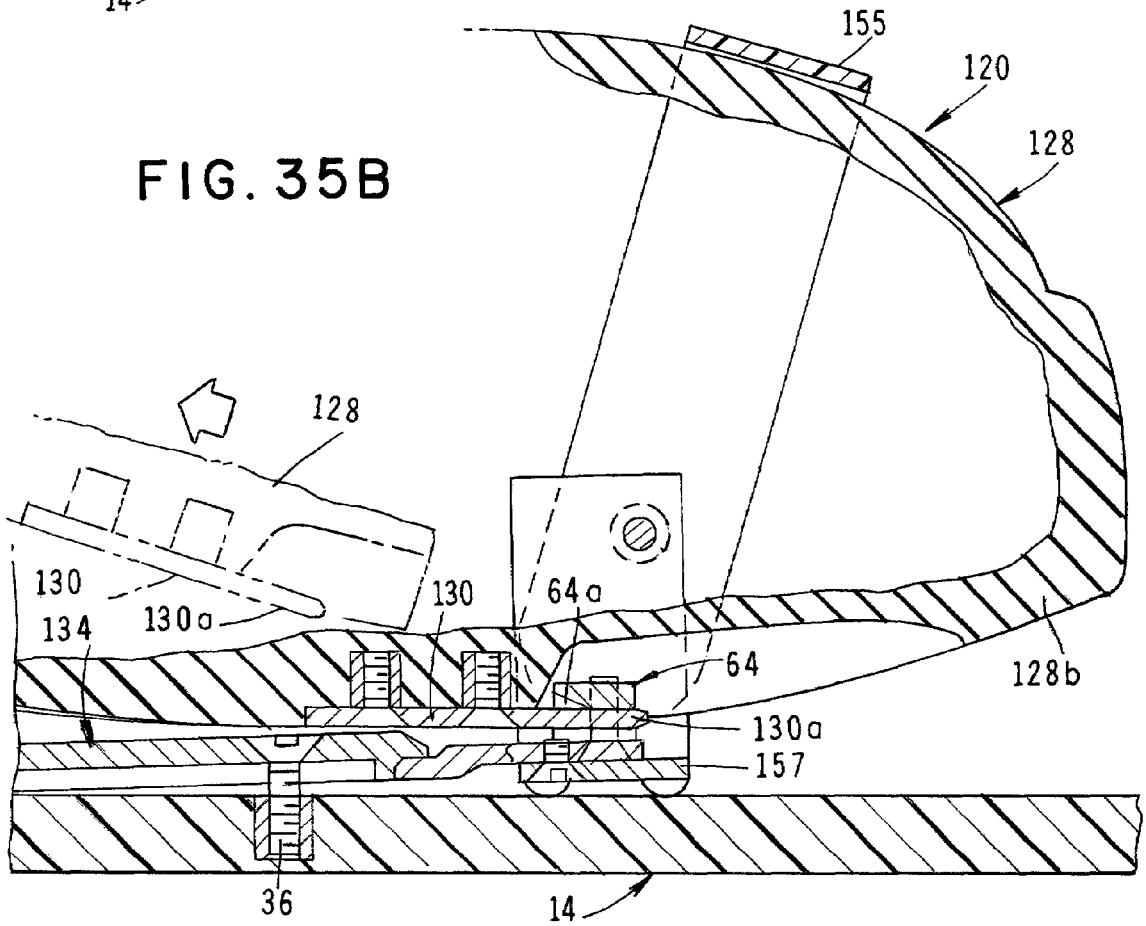

As indicated in FIGS. 29 and 34, the lower surface 120*a* of the foot enclosure assembly is provided with a threaded bore 122 that receives a threaded stud 124 that functions to connect a generally circular shaped permanent magnet 126 with the foot enclosure assembly (see also FIG. 30). Magnet 126 is of the character previously described and can comprise a powerful ceramic disk, permanent magnet.

Figure 32A:
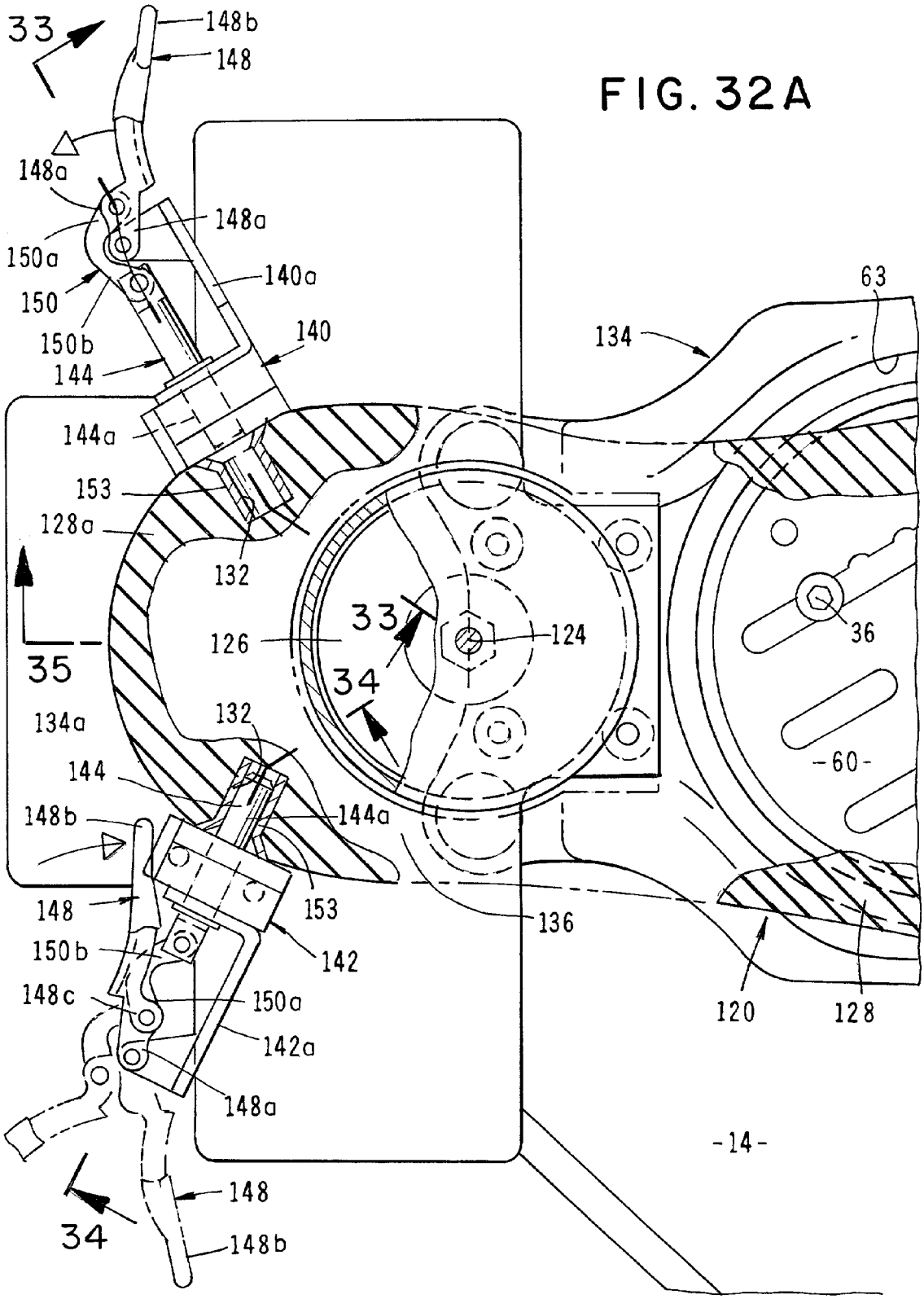
FIGS. 32A and 32B when considered together comprise an enlarged cross-sectional view taken along lines 32—32 of FIG. 31.
Figure 32B:
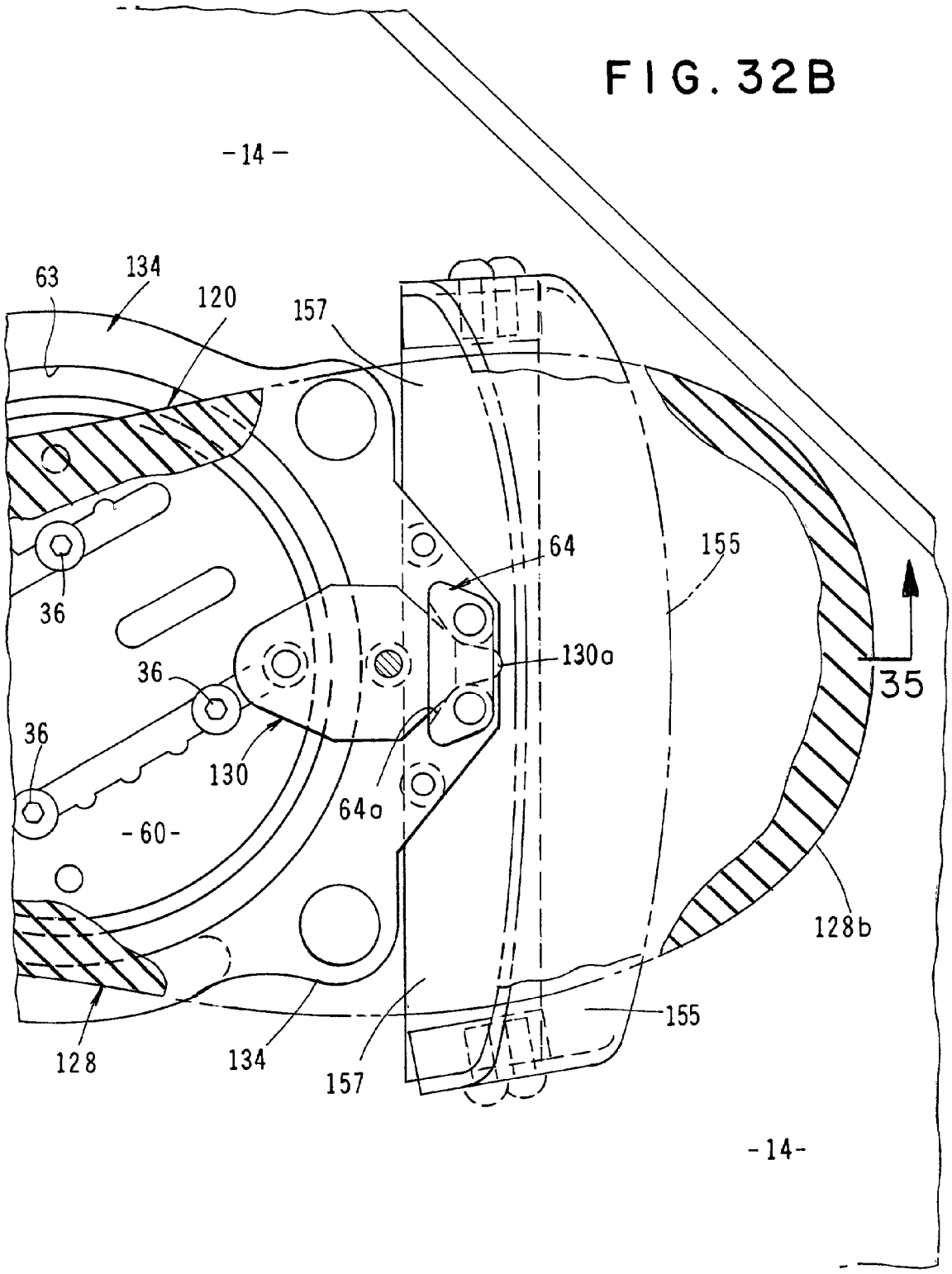
Figure 33:
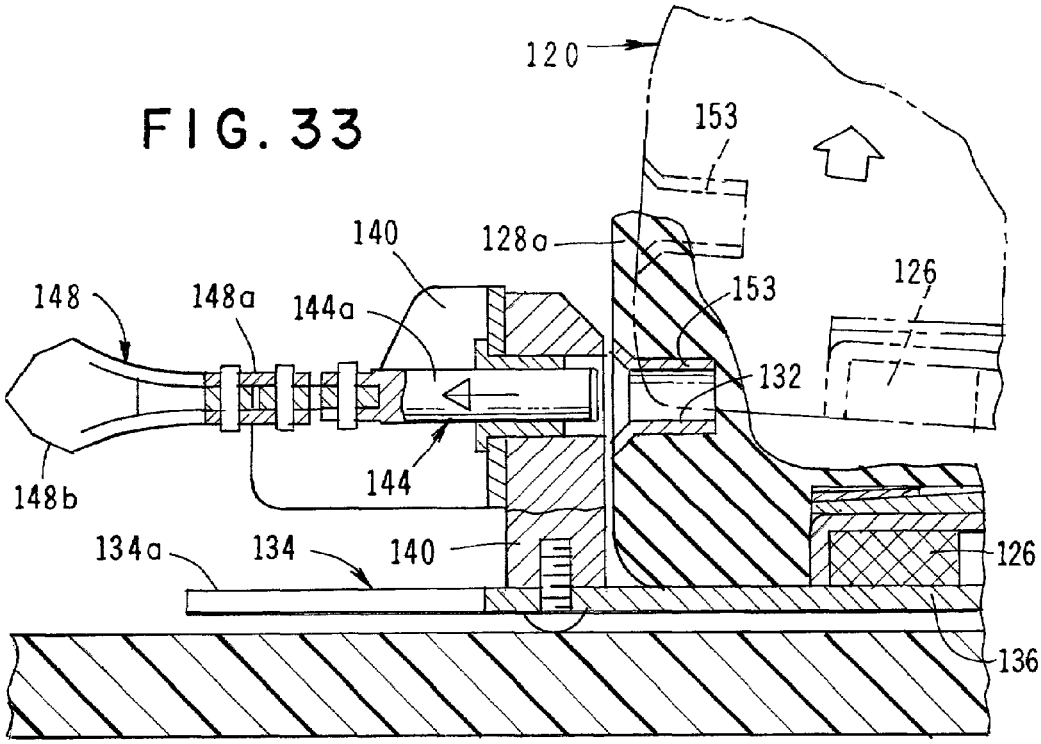
FIG. 33 is a cross-sectional view taken along lines 33—33 of FIG. 34A.
Figure 35A:
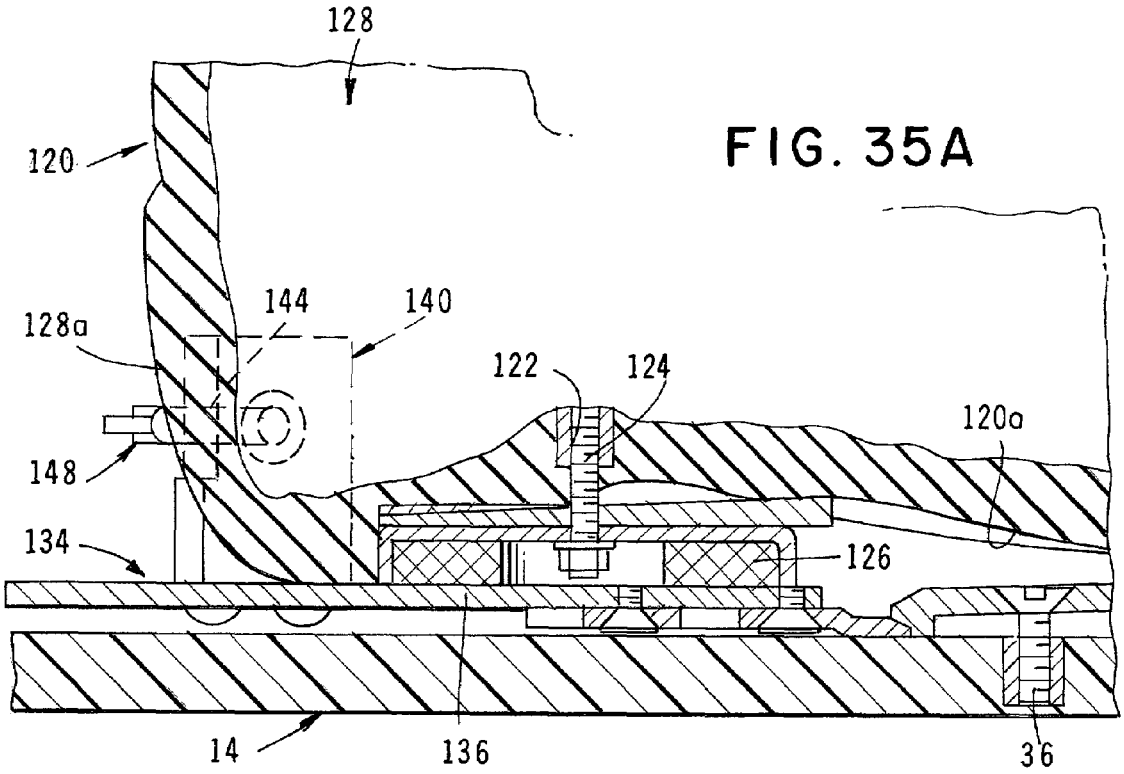
FIGS. 35A and 35B when considered together comprise a cross-sectional view taken along lines 35—35 of FIGS. 32A and 32B.

Each of the foot enclosure assemblies 120 of the present form of the invention comprises a snow boot-like foot enclosure 128 having a heel portion 128*a* and a toe portion 128*b*. A magnet 126 is affixed to the lower surface of the foot enclosure means intermediate the heel portion and the toe portion and a toe-securement means, shown here as comprising a locking tab 130 is affixed proximate the toe portion (FIG. 29). As best seen in FIG. 32A, heel portion 128*a* is provided with a pair of angularly spaced apart openings or bores 132, the purpose of which will presently be described.

Figure 27A:
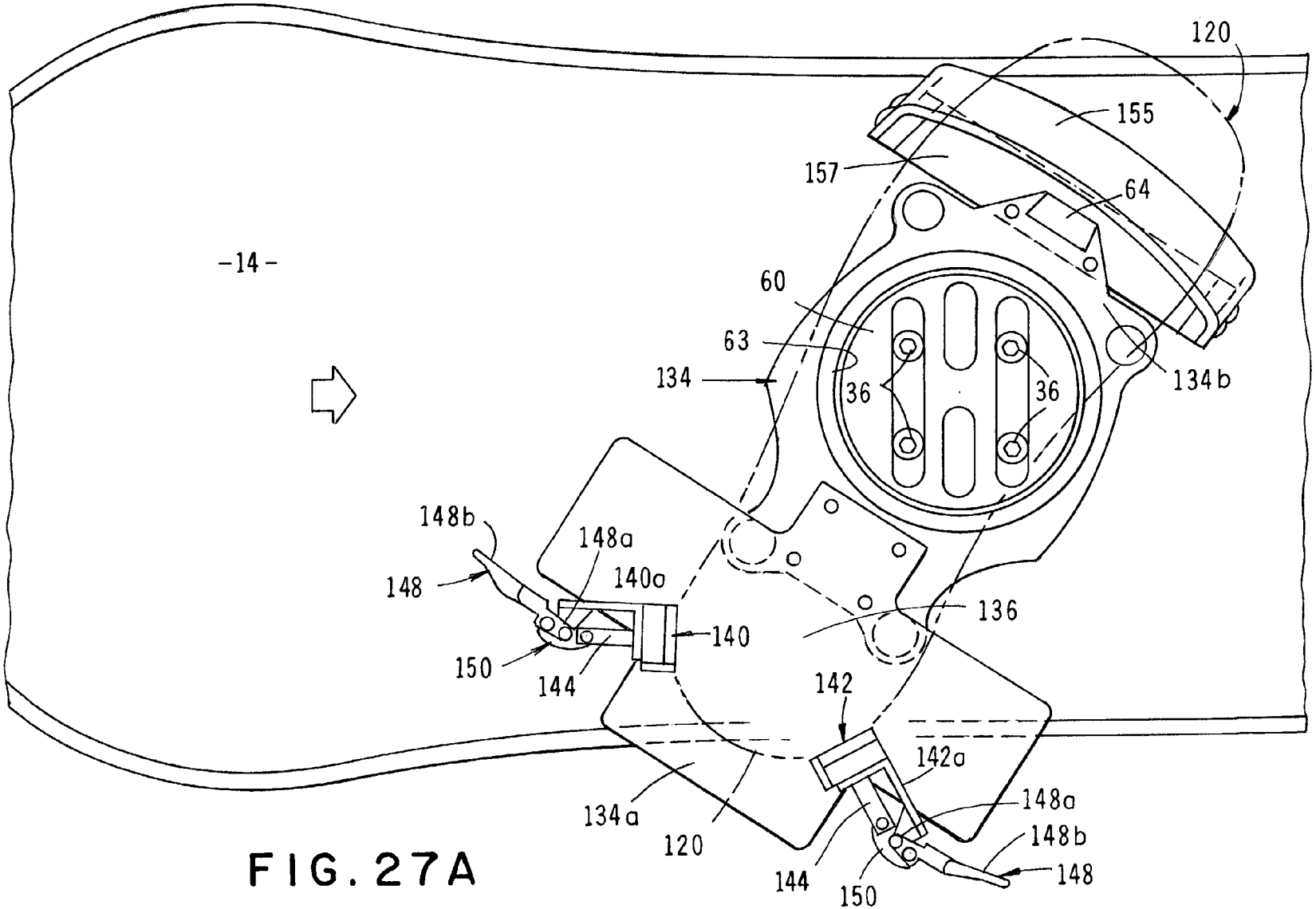
FIGS. 27A and 27B when considered together illustrate the base support and connector assemblies of still another form of the apparatus of the invention for gliding over the snow.
Figure 27B:
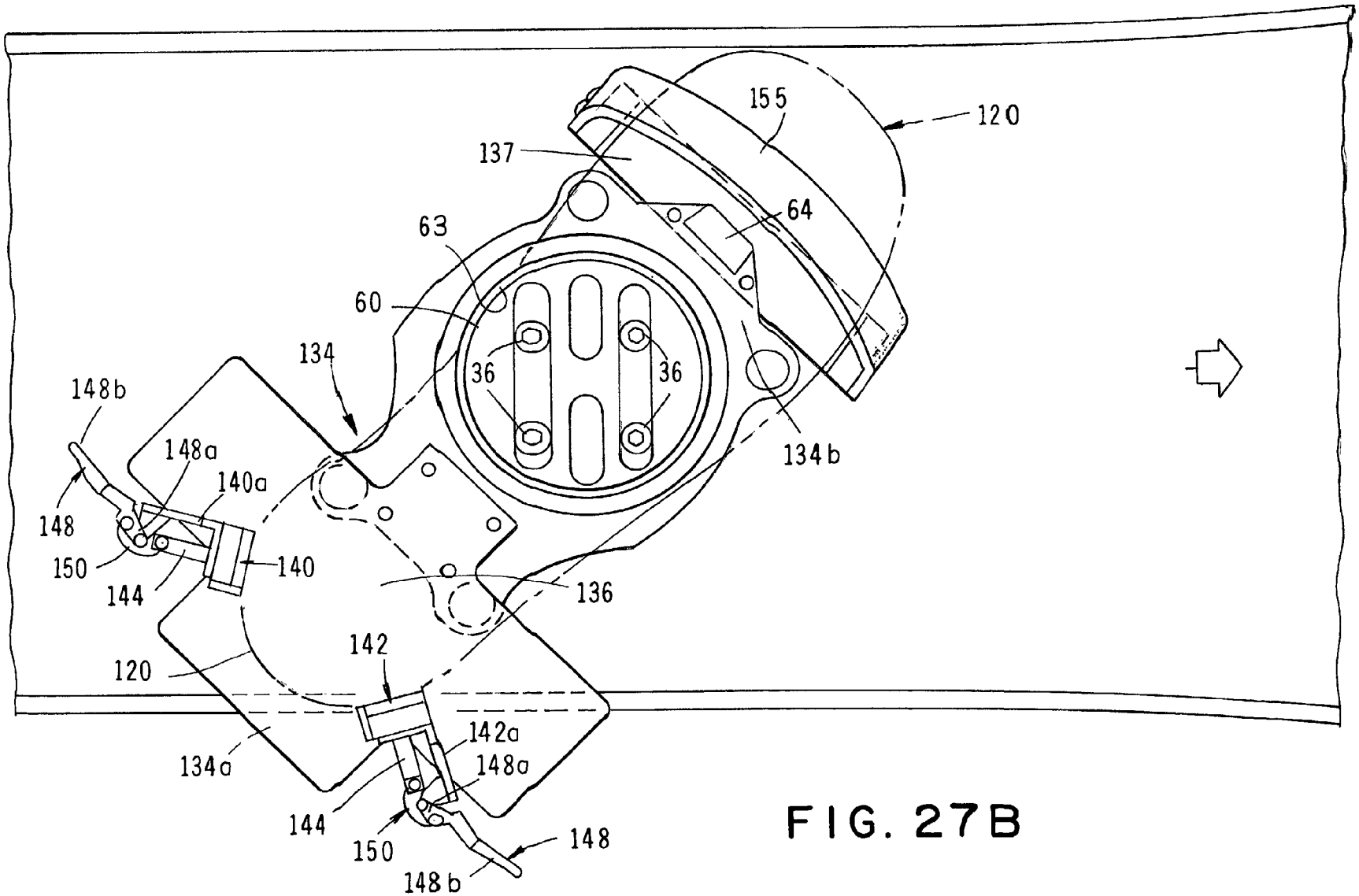
Figure 28:
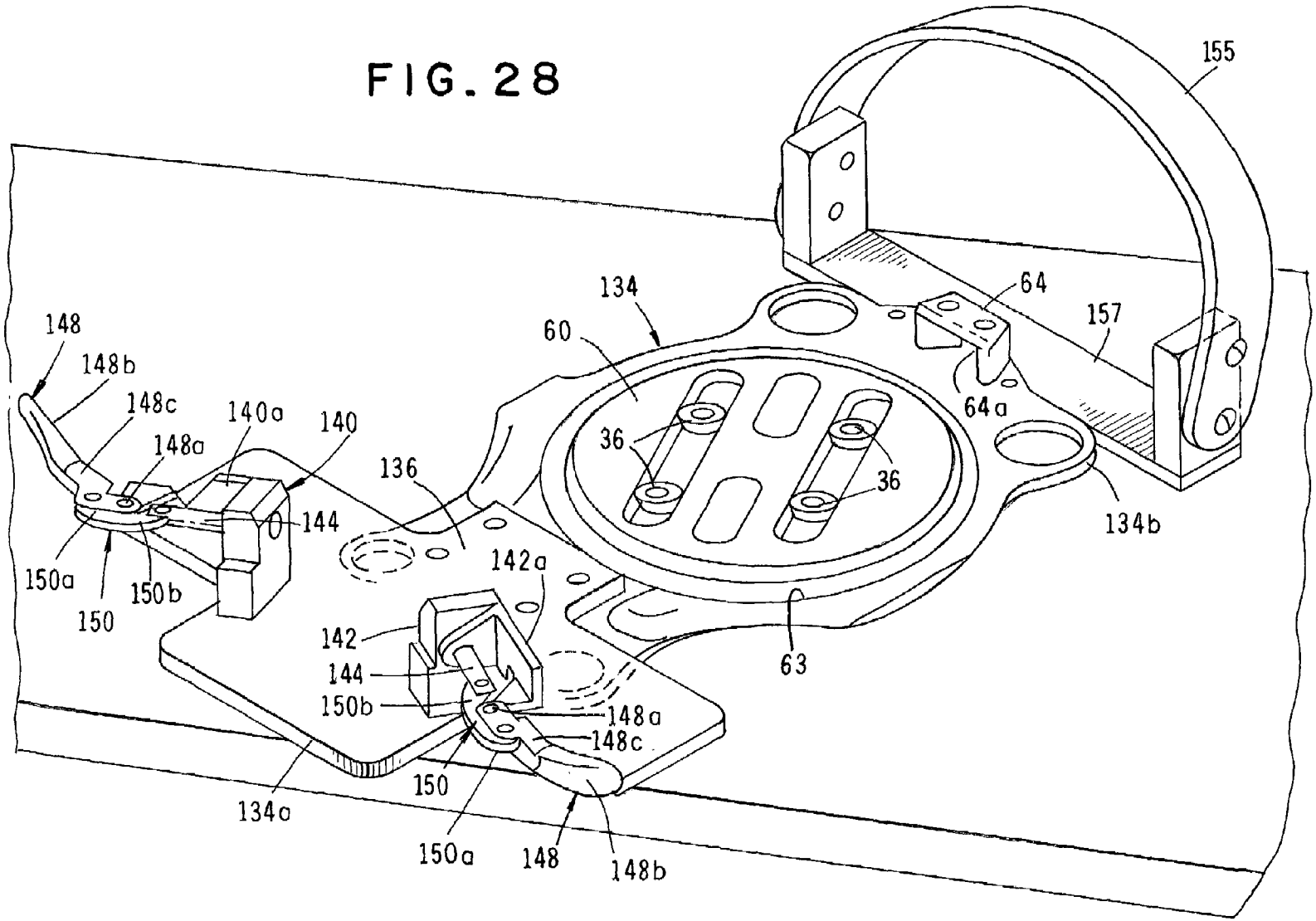
FIG. 28 is an enlarged, generally perspective view of the support base and connector means of the invention shown in FIG. 28B.

Turning particularly to FIG. 28, one of the two identical connector means of this latest form of the invention for releasably interconnecting the foot enclosure assemblies 120 with the support base 14 can be seen to comprise an elongated frame-like assembly 134 having a first end 134*a* and a second end 134*b*. As depicted in FIGS. 27A and 27B, each of the assemblies 134 is adjustably connected to support base 14 by two sets of threaded connectors 36 that are of the character previously described.

Affixed to each of the frame assemblies intermediate the first and second ends thereof is a ferrous metal plate 136 that is engageable by the magnets 126 when the foot enclosure assemblies 120 are mated with the frame assemblies in a manner presently to be described. The ferrous metal plates 136 comprise a part of the heel securement means of the invention for securing the heel portion of the foot enclosure assemblies 120 within their respective frame assemblies. The heel securement means of the invention also include first and second spaced apart mounting brackets 140 and 142 that are connected to the frame-like assemblies 134 in the manner shown in FIGS. 27A and 27B. Each of the mounting brackets 140 and 142 includes a side member identified in the drawings as 140*a* and 142*a* respectively.

Connected to each of the mounting brackets 140 and 142 are heel locking means for locking engagement with the heel portion of a selected foot enclosure assembly. In the present form of the invention, each of the heel locking means comprises a locking pin 144 having a locking extremity 144*a* that is telescopically receivable within a selected one of the angularly spaced-apart openings 132 formed in the heel portions 128*a* of the foot enclosure assemblies 120 (FIG. 32A). Also forming a part of the heel securement means of the invention are operating means connected to the locking pins for moving the locking pins 144 relative to the spaced apart openings 132 formed in the heel portions of the foot enclosure assemblies between a first locked position and a second retracted position. Each of the operating means here comprises an operating lever 148 having a first end 148*a*, a second end 148*b* and an intermediate portion 148*c*. As best seen in FIG. 32A, first end 148*a* of each of the operating levers is pivotally interconnected with a selected side member 140*a* and 142*a*. Also forming a part of each of the operating means is a connector link 150 that has a first end 150*a* that is pivotally connected to intermediate portion 148*c* of the operating lever and a second end 150*b* that is pivotally interconnected to locking pin 144. With the construction thus described, movement of the operating levers 148 from the position shown by the solid lines in the lower portion of FIG. 32A to the position shown in the phantom lines will cause the locking pin 144 to move from the first locked position shown in solid lines to the retracted position wherein the locking pin is free of the opening or bore 132 (see the upper portion of FIG. 32A). To provide greater durability, each of the bores 132 are provided with metal liners 153.

As shown in FIG. 28, each frame assembly 134 includes a generally disk shaped connector member 60 that is rotatably mounted within a central opening 63 formed in the central portion of assembly 134. Connector member 60 is identical in construction and operation to that previously described and comprises a part of the adjustment means of the invention for adjustably interconnecting the frame assemblies 134 with support base 14.

The connector means of the present form of the invention further comprises toe-securement means for securing the toe portion of foot enclosures 120 within their respective frame assemblies 134. Each of the identical toe securement means here comprises an upstanding locking element or bracket 64 that is connected to the frame assembly proximate second end 134*b* thereof (FIG. 28). Bracket 64 is provided with an opening 64*a* that closely receives locking tab 130*a* of toe locking member 130 when a foot enclosure 120 is positioned within a frame assembly 134 in the manner shown in FIG. 31.

Also forming a part of the toe securement means of this latest form of the invention is a toe strap 155 that is pivotally connected to a cross bar 157 which, in turn, is connected to frame assembly 134 (FIG. 28).

The foot enclosures can be removed from their respective frame assemblies by first pivotally moving levers 148 into the outward position shown in the upper portion of FIG. 32A wherein the locking pins are retracted from the angularly, spaced-apart bores. This done, the user can lift the heel of the foot enclosure upwardly against the urging of magnet 126 in the manner shown by the phantom lines in FIG. 33 so that the heel portion moves free of the frame assembly. Next, the user can move the foot enclosure rearwardly so that tab 130*a* of the toe locking member slides free of the locking element 64 (see the phantom lines in FIG. 35B). To interconnect the foot enclosure with the frame assembly, the reverse procedure is, of course, followed.

Referring next to FIGS. 36 through 44, still another form of the apparatus of the invention for gliding over snow is there shown. This form of the invention is also similar in many respects those previously described and like numerals are used in FIGS. 36 through 44 to identify like components. As in the earlier described embodiments of the invention, this latest embodiment comprises three principal cooperating components, namely, a support base 14, a foot enclosure assembly 160, and connector means connected to the support base for releasably interconnecting the foot enclosure assembly with the support base.

Figure 38:
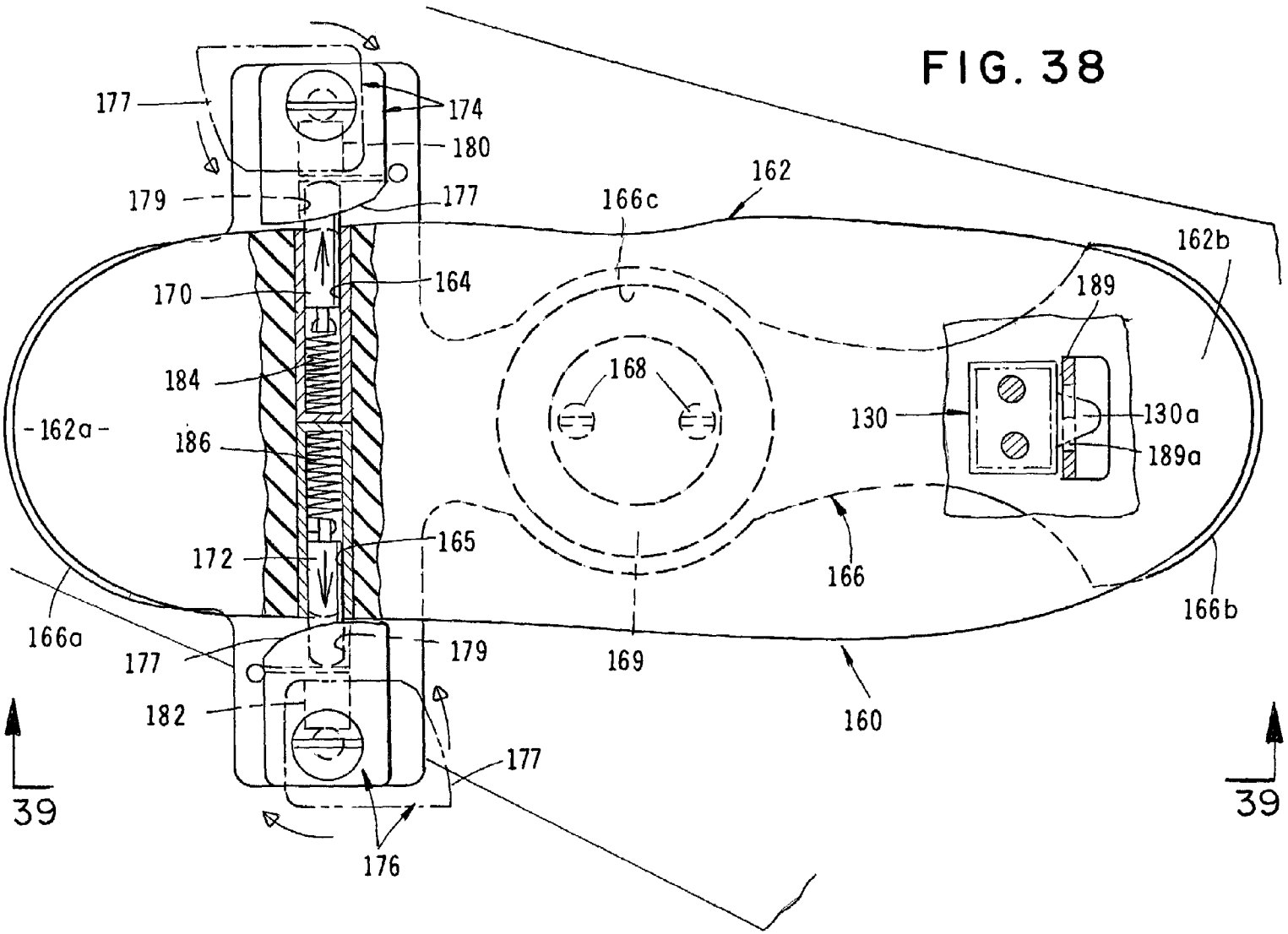
FIG. 38 is an enlarged, top view of the alternate form of the invention shown in FIG. 36 partly broken away and partly in cross section to show internal construction.
Figures 39, 41, 42:
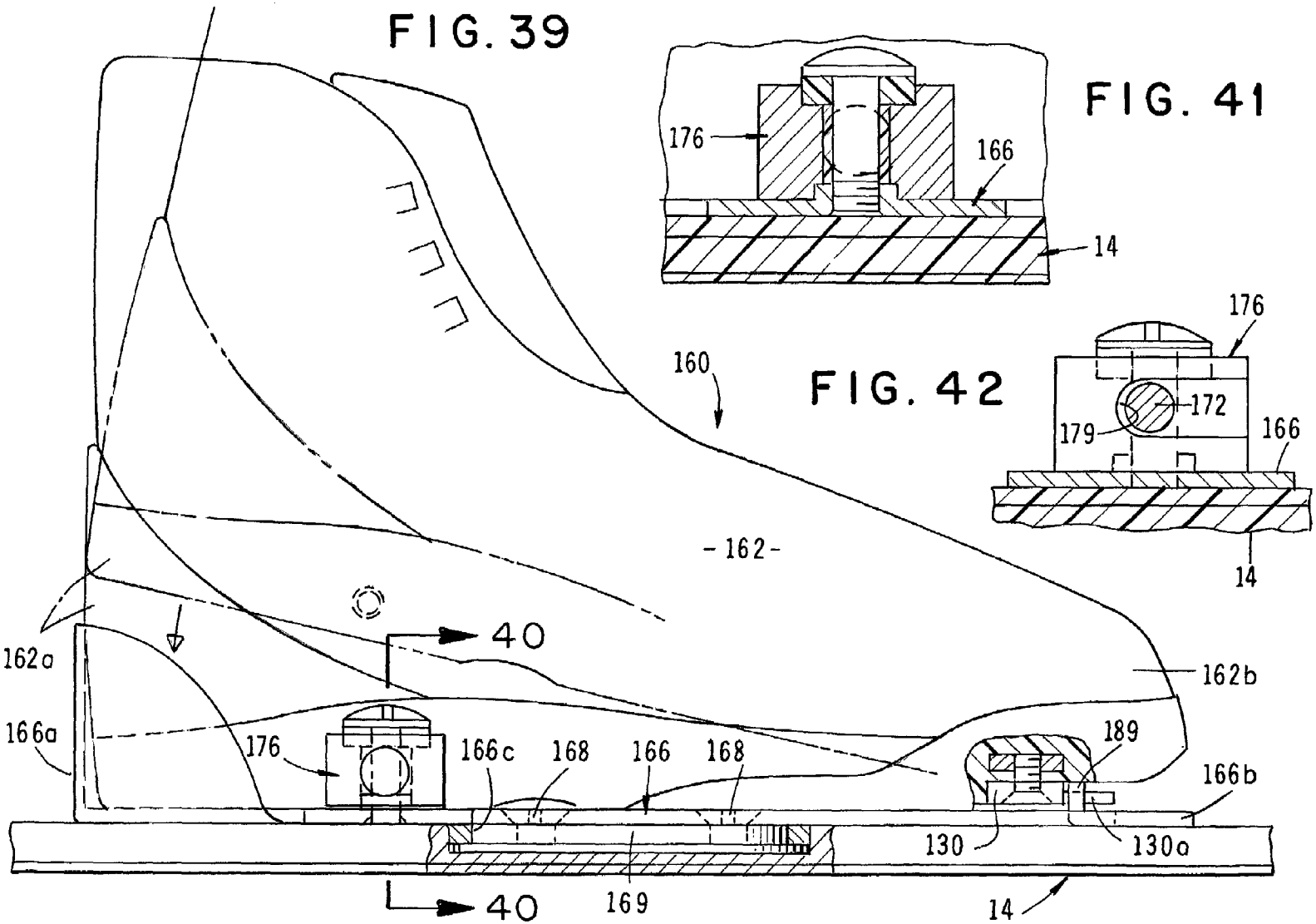
FIG. 39 is a view taken along lines 39—39 of FIG. 38.
FIG. 41 is a cross-sectional view taken along lines 41—41 of FIG. 40.
FIG. 42 is a cross-sectional view taken along lines 42—42 of FIG. 40.

As shown in FIG. 39, each of the foot enclosure assemblies 160 of the present form of the invention comprises a snow boot-like foot enclosure 162 having a heel portion 162*a* and a toe portion 162*b*. Toe-securement means, shown here as comprising a locking tab 130 is affixed proximate the toe portion 162*b* (FIG. 38). As best seen in FIG. 38, heel portion 162*a* is provided with first and second, axially aligned transverse bores 164 and 165, the purpose of which will presently be described.

Figure 36:
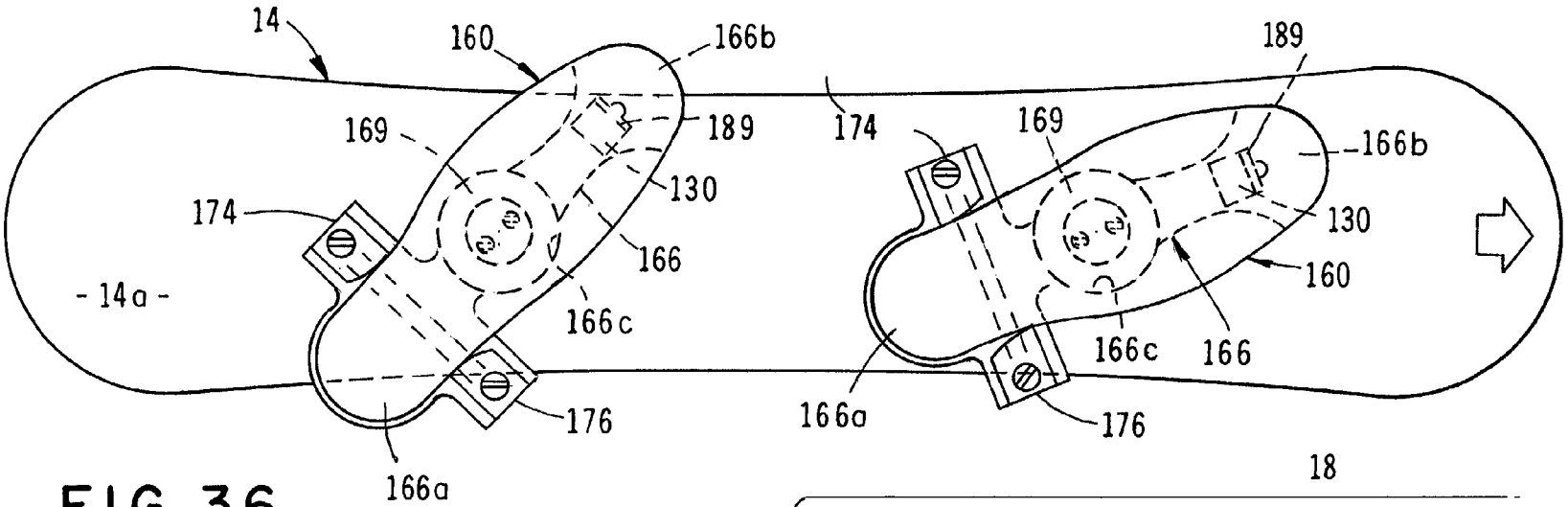
FIG. 36 is a top-plan view of still another form of the apparatus of the invention for, gliding over snow.
Figure 37:
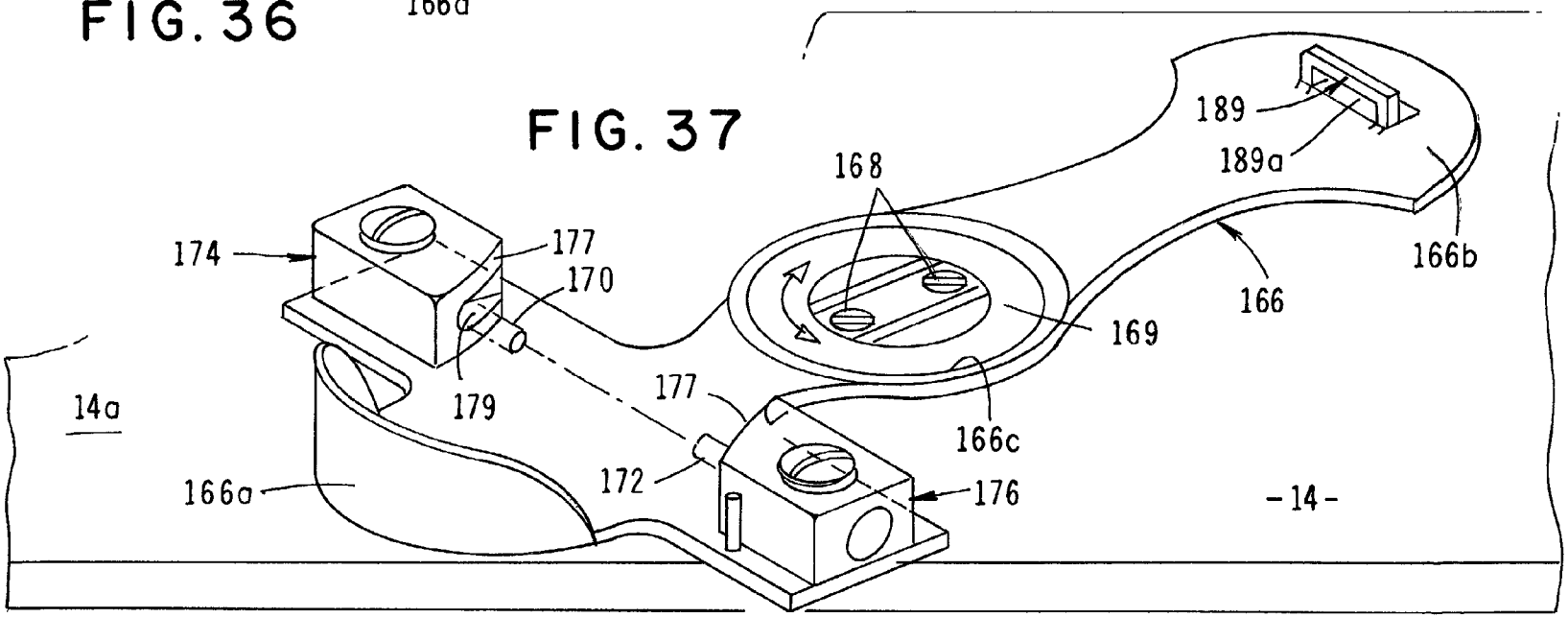
FIG. 37 is an enlarged, generally perspective view of the connector means of the alternate form of the invention shown in FIG. 36.

Turning to FIG. 36, the two identical connector means of this latest form of the invention for releasably interconnecting the foot enclosure assemblies 160 are shown connected to a support base 14. As illustrated in FIG. 37, each of these connector means can be seen to comprise an elongated frame-like assembly 166 having a first end 166*a* and a second end 166*b*. Assemblies 166 are adjustably connected to support base 14 by threaded connectors 168 and a disk like member 169 that is rotatably mounted within a generally circular shaped central opening 166*c* provided in each of the frame-like assemblies 166. With this construction, each assembly 166 can be selectively, angularly adjusted relative to support base 14 in the manner illustrated in FIG. 36.

Figure 40:
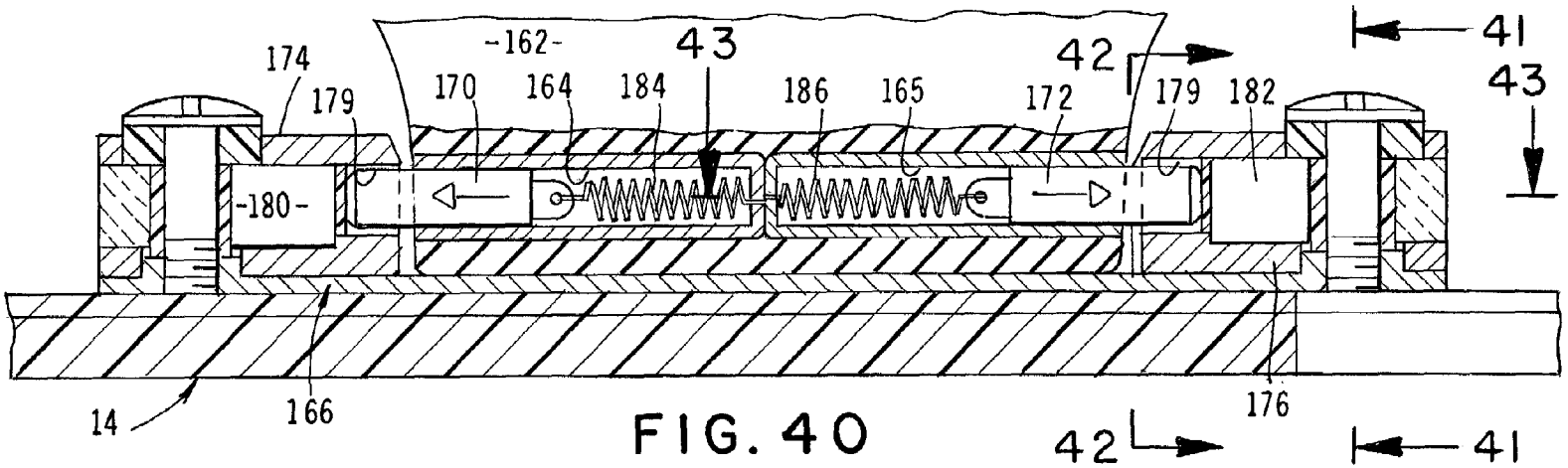
FIG. 40 is an enlarged, cross-sectional view taken along lines 40—40 of FIG. 39.
Figure 44:
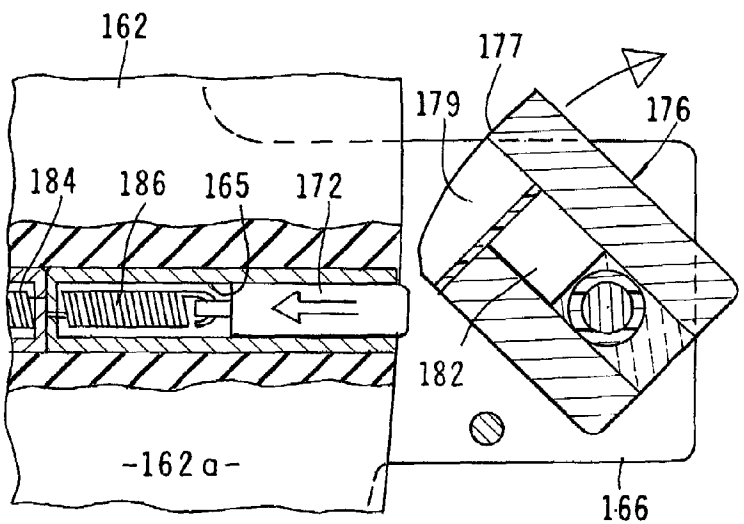
FIG. 44 is a cross-sectional view similar to FIG. 43 but showing the heel-locking mechanism moved into a released position.
Figure 43:
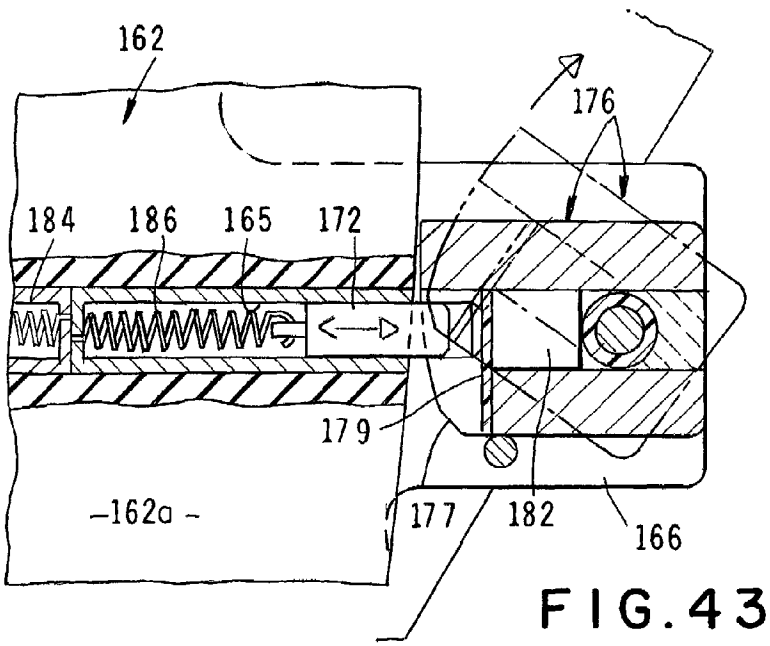
FIG. 43 is a cross-sectional view taken along lines 43—43 of FIG. 40.

As best seen in FIG. 38 a first locking pin 170 is carried within the first spaced apart bore 164 formed in heel portion 166*a* for movement between a first retracted position shown by the solid lines in FIG. 38 and a second extended, locking position shown in FIG. 40. Similarly, a second locking pin 172 is carried within the second spaced apart bore 165 formed in heel portion 166*a* for movement between a first retracted position shown by the solid lines in FIG. 38 and a second extended, locking position shown in FIG. 40. Locking pins 170 and 172 form a part of the heel connector means of the invention for releasably interconnecting the heel portions of said foot enclosure assemblies with the frames 166. The heel connector means of the invention also include a first housing 174 that is pivotally connected to frame 166 for movement between a first locking position shown by the solid lines in FIG. 38 and a second release position shown by the phantom lines in FIG. 38 (see also FIG. 44). Similarly, The heel connector means of the invention includes a second housing 176 that is pivotally connected to frame 166 for movement between a first locking position shown by the phantom lines in FIG. 38 and a second release position shown by the solid lines in FIG. 38. As indicated in FIG. 38, each of the housings 174 and 176 have a cam surface 177 that is provided with an opening 179.

Disposed within first housing 174 for urging first locking pin 170 into the opening 179 provided in the cam surface of first housing 174 when the housing is in the first locking position is first magnetic means shown here as a first magnet 180. Disposed within second housing 176 for urging second locking pin 172 into the opening 179 provided in the cam surface of second housing 176 when the housing is in the first locking position is a second magnetic means shown here as a second magnet 182.

With the foot enclosure assemblies 160 positioned within their respective frames 166 in the manner shown in FIG. 38, housing 174 is rotated from the position shown by the phantom lines in FIG. 38. Similarly, housing 176 is rotated from the position shown by the phantom lines in FIG. 38. With the housings 174 and 176 in these positions, magnet 180 will cause locking pin 170 to move against the urging of a first biasing means or spring 184 into the opening 179 formed in the cam face of housing 174. Similarly magnet 182 will cause locking pin 172 to move against the urging of a second biasing means or spring 186 into the opening 179 formed in the cam face of housing 176. With the locking pins 170 and 172 in this locked position, the heel portion of the foot enclosure assemblies 160 will be securely locked in position within frames 166. To release the foot enclosure assemblies, housings 174 and 176 are rotated into the position shown by the phantom lines in FIG. 38. As the housings are so rotated, the cam surfaces 177 will engage the locking pins in a manner to urge them toward their retracted positions and away from magnets 180 and 182 (see FIGS. 43 and 44). Once the magnetic force is broken, springs 184 and 186 will rapidly move the locking pins into the retracted positions shown in FIG. 38 (see also FIG. 44). With the pins in the retracted position, the foot enclosure assemblies can be moved rearwardly and upwardly so that locking tabs

130*a* are moved out of the opening 189*a* formed in the upstanding locking element 189 that is connected to frames 166 (see FIG. 37).

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for gliding over snow comprising:

(a) at least one foot enclosure assembly having a toe portion and heel portion having a pair of spaced apart openings formed therein and including a magnet affixed thereto intermediate said toe portion and said heel portion;

(b) at least one support base having an upper surface and a lower snow-engaging surface;

(c) connector means connected to said support base for releasably interconnecting said foot enclosure assembly with said support base, said connector means including:

(i) first and second spaced apart mounting brackets connected to said support base each said mounting bracket comprising an upstanding member having a bore therethrough and a side member connected to said upstanding member; and (ii) heel securement means connected to said first and second spaced apart mounting brackets for securing said heel portion of said foot enclosure assembly to said support base, said heel securement means comprising:

a. a ferrous metal plate affixed to said frame intermediate said first and second ends, said ferrous metal plate being engageable by said magnet affixed to said foot enclosure assembly;

b. heel locking means connected to each of said mounting brackets for locking engagement with said heel portion of said foot enclosure assembly, each said heel locking means comprising:

(i.) a locking pin having a locking extremity telescopically receivable within a selected one of said spaced apart openings formed in said heel portion of said foot enclosure assembly; and (ii.) operating means connected to said locking pin for moving said locking pin relative to said selected one of said spaced apart openings formed in said heel portion of said foot enclosure assembly between a first locked position and a second retracted position, said operating means comprising an operating lever connected to said side member, said operating lever having a first end, a second end and an intermediate portion; and a connector link have a first end pivotally connected to said intermediate portion of said operating lever and a second end pivotally interconnected to said locking pins; and (iii.) toe securement means connected to said support base for securing said toe portion of said foot enclosure assembly to said support base.

2. The apparatus as defined in claim 1 in which said toe securement means comprises a generally U shaped strap connected to said support base.

* * * * *